US012618251B2

(12) United States Patent
Hunter

(10) Patent No.: US 12,618,251 B2
(45) Date of Patent: May 5, 2026

(54) STRUCTURALLY SOUND QUICK ASSEMBLY DEPLOYABLE AND REUSABLE HOUSING SHELTERS FOR DISASTER SITES

(71) Applicant: John P. Hunter, Riverhead, NY (US)

(72) Inventor: John P. Hunter, Riverhead, NY (US)

( * ) Notice: Subject to any disclaimer, the term of this patent is extended or adjusted under 35 U.S.C. 154(b) by 212 days.

(21) Appl. No.: 18/197,047

(22) Filed: May 13, 2023

(65) Prior Publication Data

US 2023/0407656 A1 Dec. 21, 2023

Related U.S. Application Data

(60) Provisional application No. 63/342,989, filed on May 17, 2022.

(51) Int. Cl.
*E04H 1/02* (2006.01)
*E04H 1/00* (2006.01)

(52) U.S. Cl.
CPC ..... *E04H 1/02* (2013.01); *E04H 1/005* (2013.01)

(58) Field of Classification Search
CPC ..... E04H 1/005; E04H 23/08; E04B 1/343; E04B 1/3483; E04B 1/02; E04C 2/38; E04C 2/36; E04C 2/26
(Continued)

(56) References Cited

U.S. PATENT DOCUMENTS 1,421,299 A * 6/1922 Palen ..... E04B 1/26 52/93.2
2,712,863 A 7/1955 Busch
(Continued)

FOREIGN PATENT DOCUMENTS

EP 2295657 A1 3/2011
FR 482354 A 3/1917
(Continued)

OTHER PUBLICATIONS

"Prefabricated Modular Building Systems," house-matic.com. Oct. 1, 2017. 9 pages. https://web.archive.org/web/20171001082506/http://www.house-matic.com/en/construccion-modular.php.
(Continued)

*Primary Examiner* — Paola Agudelo
(74) *Attorney, Agent, or Firm* — Alfred M. Walker; Thomas A. O'Rourke; James Bongiorno

(57) ABSTRACT

Structurally sound quick assembly reusable housing shelters are assembled at disaster sites. These rapidly deployable shelters are assembled on site, and can be disassembled after their use is complete, and deployed to another disaster location. The components are built in a factory setting, so that all the tolerances can be maintained. The identical components are interchangeable. Wall and roof panels of the shelters are coated with a rugged polyurea coating, which is waterproof, mold-proof and with no corrosion. Identical T-shaped uprights are spaced equally apart along an outer perimeter of the shelter. The wall and roof panels nest in place between adjacent T-shaped uprights, which each have a flat backend and a centrally located, perpendicular protruding buttressing web extending outwardly from shelter's exterior. T-shaped roof rafters spanning respective uprights of the housing shelter unit, and have notches engaging upper portions of each upright, or vice versa.

22 Claims, 20 Drawing Sheets

(58) Field of Classification Search
USPC ..... 52/79.9
See application file for complete search history.

(56) References Cited

U.S. PATENT DOCUMENTS

| | | | | |
|---|---|---|---|---|
| 3,047,106 | A | 7/1962 | Callahan | |
| 3,063,104 | A | 11/1962 | Troxel | |
| 3,069,224 | A | 12/1962 | Bigelow | |
| 3,184,012 | A * | 5/1965 | Ishimoto | E04B 1/35 52/646 |
| 3,296,756 | A | 1/1967 | Wade | |
| 3,307,894 | A | 3/1967 | David | |
| 3,333,875 | A * | 8/1967 | Tracy | E04B 7/06 52/655.1 |
| 3,474,582 | A | 10/1969 | Wah | |
| 3,832,956 | A * | 9/1974 | Briel, Jr. | E04B 1/3483 108/55.1 |
| 4,165,591 | A | 8/1979 | Fitzgibbon | |
| 4,170,852 | A * | 10/1979 | Danis, Jr. | E04B 1/3441 52/745.06 |
| 4,272,930 | A | 6/1981 | Foster | |
| 4,584,805 | A | 4/1986 | Meiry | |
| 5,036,634 | A | 8/1991 | Lessard et al. | |
| 5,070,667 | A * | 12/1991 | Schulte | E04H 1/1205 52/584.1 |
| 5,447,000 | A * | 9/1995 | Larsen | E04B 1/34315 52/234 |
| 5,611,185 | A * | 3/1997 | Wilz | E04B 9/064 52/471 |
| 5,657,583 | A | 8/1997 | Tennant | |
| 5,950,373 | A | 9/1999 | Von et al. | |
| 6,604,328 | B1 | 8/2003 | Paddock | |
| 7,770,339 | B2 | 8/2010 | Mower et al. | |
| 8,733,029 | B2 | 5/2014 | Tiramani | |
| 8,739,475 | B2 | 6/2014 | Michaud et al. | |
| 8,973,313 | B2 | 3/2015 | Bettiol et al. | |
| 8,978,319 | B2 | 3/2015 | Patino | |
| 9,416,528 | B2 * | 8/2016 | Schaffert | E04B 1/3445 |
| 9,593,487 | B2 | 3/2017 | Harvey | |
| 10,883,264 | B1 | 1/2021 | Wee | |
| 11,149,430 | B2 | 10/2021 | Segall | |
| 2002/0116893 | A1 * | 8/2002 | Waldrop | E04B 2/7818 52/843 |
| 2008/0263968 | A1 | 10/2008 | Day | |
| 2009/0145075 | A1 * | 6/2009 | Oakley | E04C 3/12 52/690 |
| 2010/0180518 | A1 | 7/2010 | Postlethwaite | |
| 2013/0086850 | A1 * | 4/2013 | Morrow | E04B 1/04 52/309.4 |
| 2015/0233137 | A1 | 8/2015 | Trela | |
| 2016/0014995 | A1 * | 1/2016 | Bruno | A01K 1/033 119/482 |
| 2016/0032581 | A1 | 2/2016 | Sklar | |
| 2017/0145708 | A1 * | 5/2017 | Chen | E04B 1/34321 |
| 2017/0222598 | A1 * | 8/2017 | Campbell | E04B 1/34336 |
| 2017/0268218 | A1 | 9/2017 | Hilton | |
| 2018/0079589 | A1 * | 3/2018 | Meister | B65D 88/129 |

FOREIGN PATENT DOCUMENTS

| | | | |
|---|---|---|---|
| FR | 2575505 | A2 | 7/1986 |
| FR | 2583443 | A1 | 12/1986 |
| GB | 637274 | A | 5/1950 |
| KR | 100978578 | B1 | 8/2010 |
| KR | 20210107326 | A | 9/2021 |
| WO | WO 2016191771 | A1 | 12/2016 |
| WO | WO 2018119494 | A1 | 7/2018 |
| WO | WO 2020025835 | A1 | 2/2020 |
| WO | WO 2020112691 | A1 | 6/2020 |

OTHER PUBLICATIONS

Bou, Jordi. "IKEA flatpack refugee shelter," May 2, 2022. 2 pages. https://web.archive.org/web/20220502000856/https://www.graphicnews.com/en/pages/30962/tech-ikea-flatpack-refugee-shelter-1.

Sharaf, P; Nemati, S.; Ghodrat, M."Development of an Innovative Modular Foam-Filled Panelized System for Rapidly Assembled Postdisaster Housing," mdpi.com. Jul. 30, 2018. 15 pages. https://www.mdpi.com/2075-5309/8/8/97/pdf.

"Rapid Response Disaster Relief," fortsusa.com. Apr. 6, 2015. 5 pages. https://web.archive.org/web/20150406000657/https://fortsusa.com/models/emergency/disaster-relief/.

"SIP Panel Simple Shelters Durable Emergency or Off Grid Housing," innovativebuildings.com. Nov. 19, 2019. 7 pages. https://web.archive.org/web/20191119155222/https://innovativebuildings.com/simple-shelters-emergency-and-alternative-housing/.

Declaration signed by John P. Hunter on May 23, 2023. 4 pages.

* cited by examiner

STAND ALONE

Fig. 9
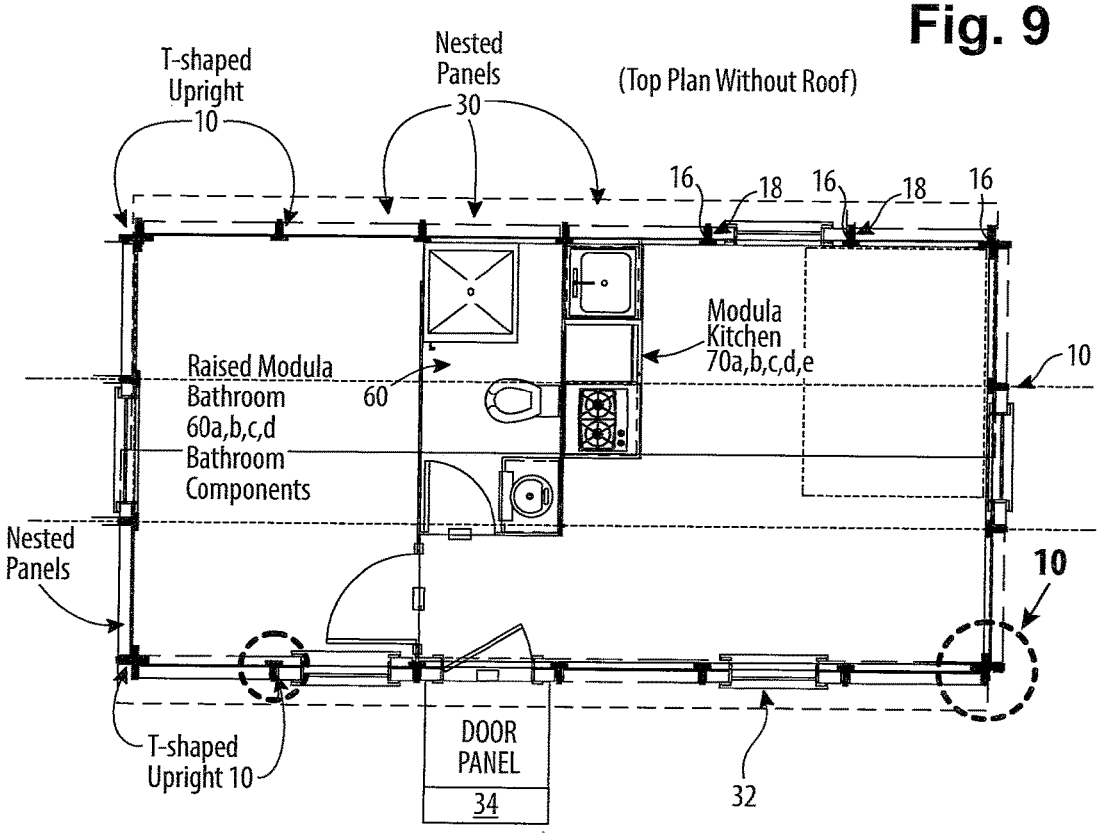
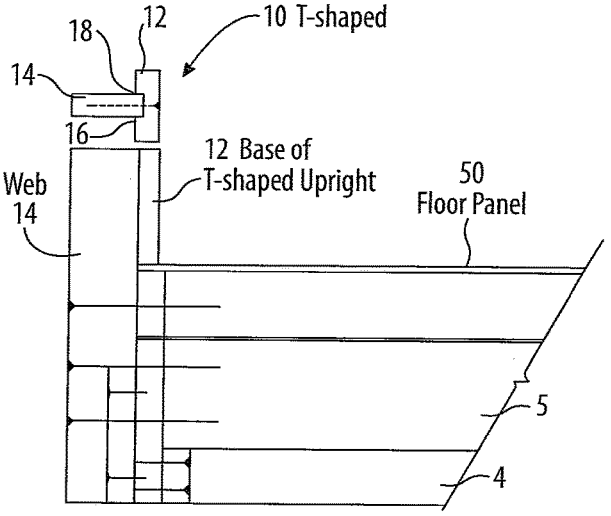
Fig. 10A
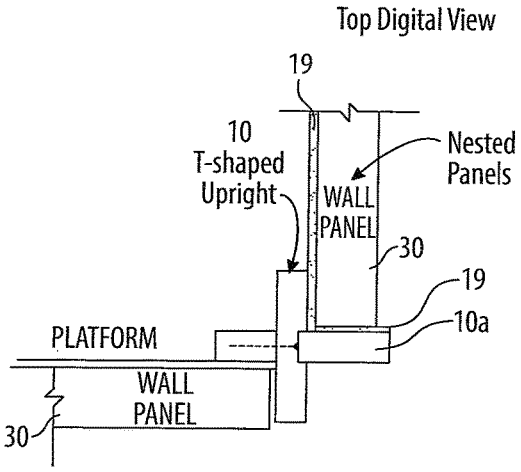
Fig. 10

Workers Carrying Wall or Roof Panel Polyurea
Coated Panel with Risen Thermo-Foam Inside Workers Nesting Panel Window Wall Panel
in Corners of Adjacent T-shaped Uprights Partial Installed Wall Panels
Nested between Corners of T-shaped
Uprights, Over Raised Floor Workers Installing Window
Installed in Panel to be Nested between
T-shaped Uprights Workers Installing Removable Fasteners
in Pre-Drilled Receptacle Holds Gable being Installed with Adjoining T-shaped
Roof Rafters and Removable Fasteners Installed Gable Member Showing Joined T-shaped Roof Rafters, Joined at Apex with no Intervening Ridge Beam Roof Parcels Nested after being Slid in place between T-shaped Roof Rafters, showing one Foot Overhang Hang Tail at Distal end of Nested Roof Panel Roof Rafters Joint to T-shaped Uprights with Precise Angled Notch to Insure Verified Plumb Line of Structural Sides Nested Roof Panel being Slid in Place within Adjacent T-shaped Roof Rafters Partially Completed Shelter House
Showing Roof Rafters Connected to T-shape
Uprights within Notch of Roof Rafters Interior View of Assembled Shelter Electrical Utility Line Installed
Adjacent to Interior of Uprights Completed Shelter Home Ready for Use or
Take Down and Transport to another Crisis Location Group of Assembled Structures

STRUCTURALLY SOUND QUICK ASSEMBLY DEPLOYABLE AND REUSABLE HOUSING SHELTERS FOR DISASTER SITES

RELATED APPLICATIONS

This application claims benefit of provisional application No. 63/342,989 filed on May 17, 2022, pursuant to 35 U.S.C. § 119(e). The '989 application is incorporated by reference herein.

FIELD OF THE INVENTION

The present invention relates to housing shelter structures that can be rapidly and easily assembled for persons in need after a natural or man-made disaster, and which can also be easily and quickly disassembled when their emergency use is completed, so that they can be transported quickly to another nearby location at the disaster site, or be transported to a distant location after a different natural or man-made disaster has occurred elsewhere.

BACKGROUND OF THE INVENTION

T-shaped joists have been used previously in housing structures to support flat wall panels, which walls may be between two spaced apart T-shaped joists, where the T shaped joists have a flat base located on the exterior of the walls of the structure, and the protruding mid flange of each of the T shaped joists extends inward into the interior of the structure.

One problem with using T shaped joists with an interior extending/protruding mid flange is that the bottom of the wall panel held between the T-shaped joists is positioned flush with the floor of the interior of the structure. Therefore, rainwater or flood water can seep in at the bottom of the joists and the bottom of the wall panels right into the level of the interior floor of the structure. Often such structures that may be built as replacement housing have to be installed at an elevated location being several feet off the ground, to avoid ground level seepage.

Some prior art patents for portable housing include U.S. Pat. Nos. 3,069,224 to Bigelow and 5,070,667 to Bigelow, Republic of Korea patent application number KR100978578 B1 and French Patent Number 482,354 of Société Civile D'Architecture Industrielle. Bigelow teaches the use of an inwardly extending T-shape, as shown in FIG. 3 of the '224 patent, however the "side connector elements 32" are flattened, and provide no real cross-sectional strength to support the "walls 10," and therefore does not furthermore provide a structurally sound temporary shelter.

SUMMARY OF THE INVENTION

In keeping with the following objects and others which may become apparent, the present invention is for quick and easily deployable and disassemblable housing shelters for disaster sites and other areas where there is a need for rapidly deployable housing structures for people in need.

The herein disclosed house structures can be rapidly deployed to, and be quickly assembled on location at, a disaster area (flood, earthquake, fire, hurricane, Covid etc.), and which, on the other hand, can also be rapidly disassembled, after the temporary shelter is no longer needed. A single housing shelter as disclosed herein may constitute a bundled up set of longitudinally extending T-shaped upright posts, which support nested in spaces between corners of base legs and outwardly extending base web unit the vertical wall panels, where the uprights can also function as longitudinally extending T-shaped roof rafters, also for nesting the same panels as roof panels.

All of the components of the housing shelter structure can be taken apart and reassembled a multitude of times, particularly because no nails are used, which would otherwise cause degradation of the components when being hammered for disassembly. The nails also leave indelible marks. All of the holes for the screws are also predrilled so as not to rip apart the wall panels, and cause irreparable damage when the unit may be destined for immediate reassembly at another location of critical need.

Basically, the T-shaped upright posts are set with protruding lengthwise extending buttressing web leg sections, extending out perpendicular to the lengthwise extending surface of the base legs, forming generally squared-off, concave receding areas between two of the perpendicular protruding lengthwise extending web leg sections. As such, two adjacent upright posts, spaced about 30 inches apart, may be provided to "nest" two or three inch thick foam risen filled panels, having rectangular shapes of about thirty inches in width and eight feet in length, so that the wall panels nest in the squared off, concave receding areas between the perpendicularly and outwardly extending lengthwise buttressing web leg sections of the eight foot T-shaped uprights.

The roof of the housing shelter structure forms a gable with a lengthwise extending peak, formed by pairs of angularly extending roof rafters, which may have the same dimensions as the upright posts, except that the roof rafters have corresponding angular notches accepting the corresponding vertically extending T-shaped uprights, to maintain the T-shaped roof rafters in place above the T-shaped uprights, while also assuring a vertical plumb line of the vertical walls of the housing structure.

Preferably the angle of the roof gable has a 12 over 6 horizontal to vertical ratio.

The tops of the T-shaped uprights fit into the angularly cut notches of the T-shaped roof rafters, to securely accommodate the angularly placed T-shaped roof rafters. These angled notches are provided in the lower end of the T-shaped roof rafters, which nest the roof panels therebetween. The distal one-foot lengths of the nested roof panels form collectively the roof overhang tails of the deployable and disassemblable housing shelter structure.

The eight-foot by thirty-inch wall (and roof) panels also nest between the aforementioned pairs of the upright T shaped posts which act as roof rafters. Like the upright posts, the roof rafters are also T-shaped in cross section, with a base leg portion and a perpendicularly and outwardly extending buttressing web leg portion. They connect angularly at a peak, forming a truss, but not a truss that can't be disassembled. The same wall panels become roof panels, where seven feet of each roof panel slidably nests between perpendicular buttressing web leg sections of adjacent rafters (T-shaped also), so that the extra one foot remaining of the 8-foot panels form the overhang tails of the roof. Therefore, the sets of two joining roof rafters having the nested panels therebetween form the room where seven feet of each panel forms the sloped roof and the remaining one foot at the distal ends of the panels forms the roof overhang tail for each panel of the roof.

Windows and a door are pre-built into panels. For safety, one of the windows is preferably an "egress" window.

These rapidly deployable and disassemblable housing structure shelters are assembled on site, and can be disassembled after their use is complete, and then be deployed to another disaster location. The components are built in a factory setting, so that all the tolerances can be maintained, and so that every part is identical to the next part. The parts for different houses can be interchanged because the components are identical. Unlike conventional SIP panels ("Structurally Insulated Panels") which require all kinds of adhesives, finishings and coatings, the panels of the housing structure shelters disclosed herein are coated with a specialized polyurea coating, which is a very rugged coating that is completely waterproof, mold-proof, with no corrosion. It is noted that the same polyurea coating is used by the military for blast mitigation. Polyurea compounds are inert elastomeric substances created by combining an isocyanate compound with a synthetic resinous compound.

Each housing shelter structure goes together with screws (or other similar fasteners) that are installed using a powered screw gun, and the entire housing shelter structure comes apart with the same screw gun or other similar powered devices. The screws or threaded fasteners fit within predrilled holes, so that the threads of the screw or other fastener do not damage the panels or upright studs into which they are inserted. When the housing shelter structure is fully complete and fully assembled, there's a 360-degree connection point all the way around, floor to wall, wall to ceiling, back down around again. Therefore, when the wall panels stand up and the roof panels are laid in place on-site, there is no separate roofing needed over the positioned roof panels and there is no separate siding shingles or boards required over the standing wall panels. The assembled housing shelter structure is completed and done. It is a fully panelized, interlocking system that's put together, fully with removable fasteners in predrilled holes. No permanently installed nails or roofing connectors are needed.

Because of the housing shelter is intended to be assembled and disassembled rapidly, and a multitude of times, it is formed of the aforementioned unique connection details, and as such, the assembled shelter housing structures can withstand Category 1 Hurricane force winds, depending upon how the housing structure is fastened to the ground.

The plumbing is also created in the factory setting, and may be installed in one single step. A bathroom module of the shelter housing structure is delivered as a singular unit and simply placed inside. The kitchen also formed as a manufactured module, which may be placed next to the bathroom module, so that water for the kitchen is accessible through the hollow space under the bathroom flooring. The kitchen module is essentially a one-piece kitchenette, with a stove, refrigerator, sink, etc. There's no additional plumbing required when the housing shelter structure is assembled on-site. Electric power wiring comes in a system of flexible harnesses that merely get rolled out in the house. The interior lighting is preferably provided by LEDs, which require very little electric power. Utility heating and air conditioning is efficient because of the use of a mini split extremely efficient HVAC unit, which is preferably powered by a solar panel. Therefore, the shelter housing structure can typically be one hundred percent "off grid" from local power utility companies, with these bathroom and kitchen module units and the mini-split HVAC unit. The standard base unit is a one-bedroom, one-bath unit, typically having interior floor space size of 12 feet×24 feet (i.e., 288 square feet). A two-bedroom unit can be proportionately larger, with more T-shaped uprights and rafters, combined with standard eight feet by 30 inch wide wall and roof panels. The house shelter unit can be altered by size, preferably being in increments of four feet to create shelters that may be one bedroom, two-bedrooms, three-bedrooms, etc. Optionally the housing shelter structure can be 16×32 feet as a base model, as opposed to the current model of 12×24 feet in dimensions. The uniqueness in these housing shelter structures is that they were designed not just to be assembled and built at one location, but they were specifically designed to also be disassembled and shipped to another geographic location in need. All of the structural elements and fasteners are specifically designed to come apart, without any permanent elements, such as non-removable nails or adhesives. Therefore, the housing shelter structures can be disassembled, cleaned, flat packed, stored in a 16-foot pod, and used at a different location at a different time, over and over again.

Everything arrives at the new site in the transportation pod, including the kitchen, the bathroom, the doors, and the windows, which may already be installed in some of the panels. All of the components of each housing shelter structure are constructed in a factory, piece-by-piece, and then assembled in place, in the field of the geographic area in need, due to natural disasters, such as flooding, fire, earthquake or other weather or man-made disasters.

But, when the housing shelter structures are disassembled, there is zero footprint left at the previously build site. Everything is left undisturbed, and the build site is vacated as if the assembled housing shelter structure was never there.

The assembled housing shelter structures are particularly suited for a natural or man-made disaster area that needs quick, well-constructed homes for people who have lost their homes.

The main focus of the method of assembling rapidly built housing shelter structures is primarily on disaster relief, but the housing shelter structures can function as remote recreational camping or hunting cabins up in wooded and other remote areas. The housing shelter structures can also function as a recreational lakeside fishing cabin, or they can be assembled in a residential backyard to be used by an aging parent that wants a little bit of separation from grown-up children occupying a primary residence.

These shelters are suitable for purchase by the United States Federal Emergency Management Agency (FEMA), which organization may install the housing shelter structures at various locations for residential occupancy in disaster areas, where people in need occupy these housing shelter structures for a period of time, such as for six, eight or ten months, after which the housing shelter structures are disassembled, cleaned and inspected for subsequent assembly elsewhere. Any damage to any components results in replacement of the damaged component before it's packed in a transportation and storage pod for subsequent reuse. Therefore, the life cycle assembly and occupancy costs on these housing shelter structures is very low.

The housing shelter structures can be transported all over the world in a storage and transportation pod and be assembled/reassembled in about a day's time so that, by the end of the assembly day, somebody in need of immediate substitute housing can be living within a well-constructed housing shelter structure that is energy efficient, comfortable, and beautiful in architectural exterior and interior occupancy.

For example, while the protruding exterior ribs of the uprights and roof rafters' function in a utilitarian way to nest the wall or roof panels tightly in place, with accurate plumb lines established and weatherproofing stability, the array of these protruding buttress-like exterior support elements offer a crisp design element to the exterior look and feel of the housing shelter structure itself. These design elements greatly enhance the shape of the housing shelter structure, while maintaining its utility as a rapidly assembled or disassembled housing shelter structure for persons in need after a natural or man-made disaster.

BRIEF DESCRIPTION OF THE DRAWINGS

The present invention can best be understood in connection with the accompanying drawings. It is noted that the invention is not limited to the precise embodiments shown in the following drawings, in which:

FIG. 9 is a top plan view of the rapidly deployable housing shelter of FIG. 1, also showing the positions of the T-shaped uprights and nested wall panels, nested in spaces between corners of base legs and the outwardly extending mid flanges, as well as locations of the bathroom and kitchen modules located therein.

FIG. 10 is a close-up detail view showing a T-shaped upright nesting a portion of the wall panel.

FIG. 10A is a close-up detail view of the connection of the lower portion of an upright with a frame joist/girder extending up from the foundation.

FIG. 30 also shows a preferred embodiment where the wall panel 30 can extend down to the ground level below the floor level and/or the concrete foundation by a lower portion. The wall panel may extend a predetermined distance below the floor This lower predetermined portion of wall panel, which solves the problem of ground level seepage because the lower portion of the wall panel can extend outside the housing structure between the flanged T-shaped joists, which hold the wall panel on the outside of the temporary housing structure.

DETAILED DESCRIPTION OF THE INVENTION

Figure 1:
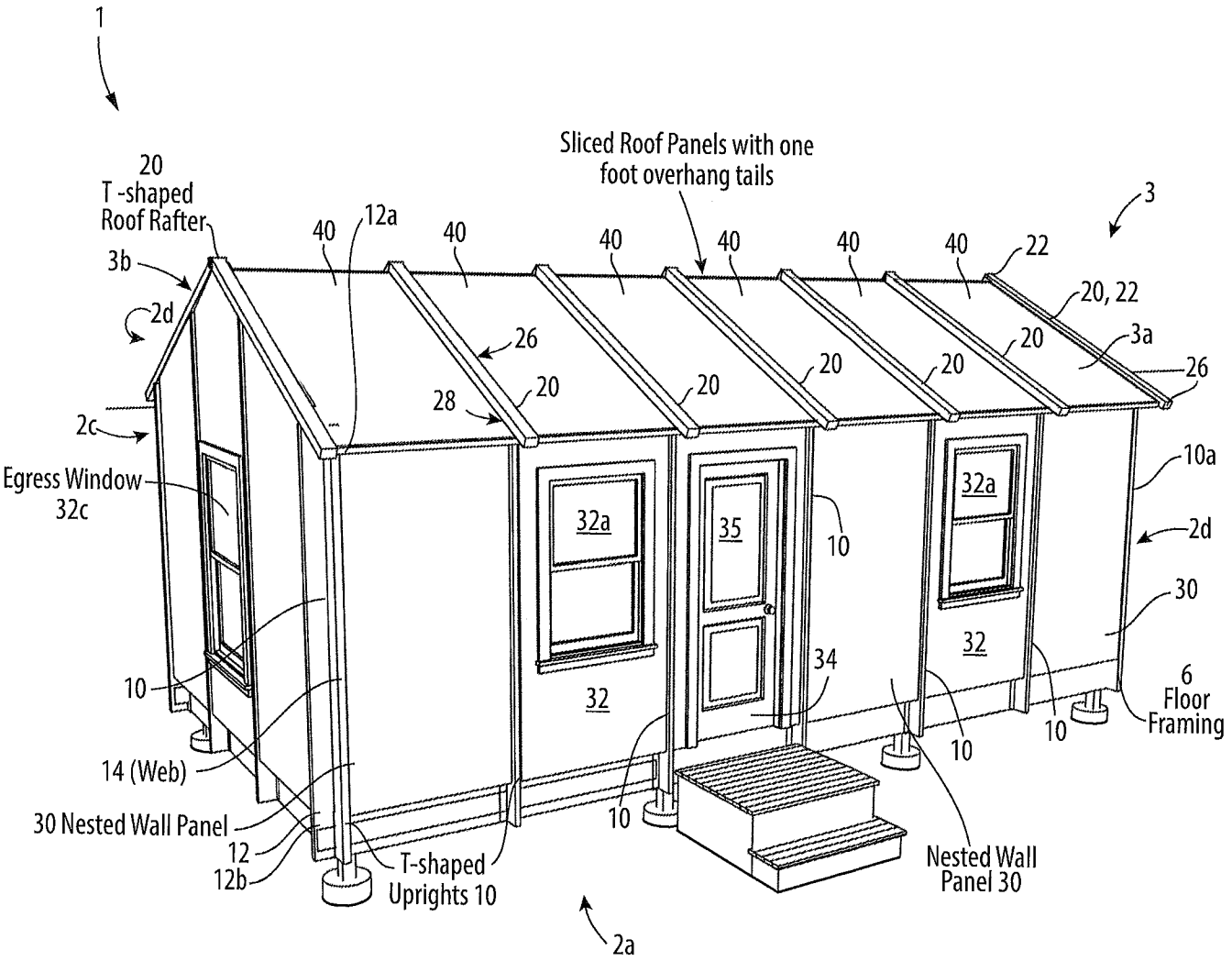
FIG. 1 is a perspective view of the rapidly deployable housing shelter unit.

The present invention has broad applications to many technical fields for a variety of articles. For illustrative purposes only, a preferred mode for carrying out the invention is described herein, for a structurally sound quick assembly deployable and reusable housing shelters is assembled and disassembled at natural or man-made disaster sites in need of emergency housing shelters for residents.

For example, as shown in drawing FIGS. 1-30, a modular house shelter unit 1 is configured for assembly and disassembly using only screws 80 and a screwdriver 82 for removably fastening the screws 80 within pre-drilled holes 81. The modular house shelter unit 1 includes a front wall façade 2, a rear wall façade 2*a*, a left side end wall façade 2*b* and a right side end wall façade 2*c*, The upright frame of the modular house shelter unit 1 includes a plurality of uprights 10, each of the plurality of uprights 10 are formed with a T-shaped cross-section having a base leg 12 extending between a top 12*a* and a bottom 12*b*, and an outstanding web leg 14 protruding away from the base leg 12. Each façade 2, 2*a*, 2*b* and 2*c* includes a plurality of wall panels 30, wherein each of said plurality of wall panels 30 in configured to nest in modular spacing 15 between the outstanding web leg 14 of each adjacent pair of respective uprights 10.

The modular house shelter unit 1 also includes a gabled roof 3 provided with a front roof portion 3*a* and a rear roof portion 3*b*. The roof 3 includes a plurality of pairs of roof rafters 20; each roof rafter 20 formed with a T-shaped cross-section having a base leg 22 and an outstanding web leg 24 protruding away from the base leg of the rafter 20. Each pair of roof rafters includes a first rafter 20, a second rafter 21, and a connector 44. Each connector 44 is configured to join a first end 20*a* of the first rafter 20 to a first end 21*a* of the second rafter 21 to form a triangular, gabled shape, wherein each respective pair of roof rafters 20, 21 are positioned, in the triangular shape, to rest upon, and releasably secure to, an opposing pair of the plurality of uprights 10, 10*a*. The roof 3 also includes a plurality of roof panels 40, 40*a* wherein each of the plurality of roof panels 40, 40*a* is configured to nest in modular spacing 25 between respective pairs of outstanding legs 24 of each adjacent pair of the roof rafters 20, 20*a*, to form a gable roof 3 without a conventional ridge plank.

The roof connectors 44 are preferably a hinge, such as, for example, a pivoting hinge strap, where each hinge 44 is configured to pivotally couple the first end 20*a* of the first rafter 20 to the first end 21*a* of the second rafter 21, being thereby configured to occupy a retracted position for transport. The first and second rafters 20, 21 are positioned substantially parallel to each other, and in an extended position, where the first end 20*a* of the first rafter 20 butts against the first end 21*a* of the second rafter 21, and the first and second rafters 20, 21 form the gabled triangular shape of the roof.

Figure 30:
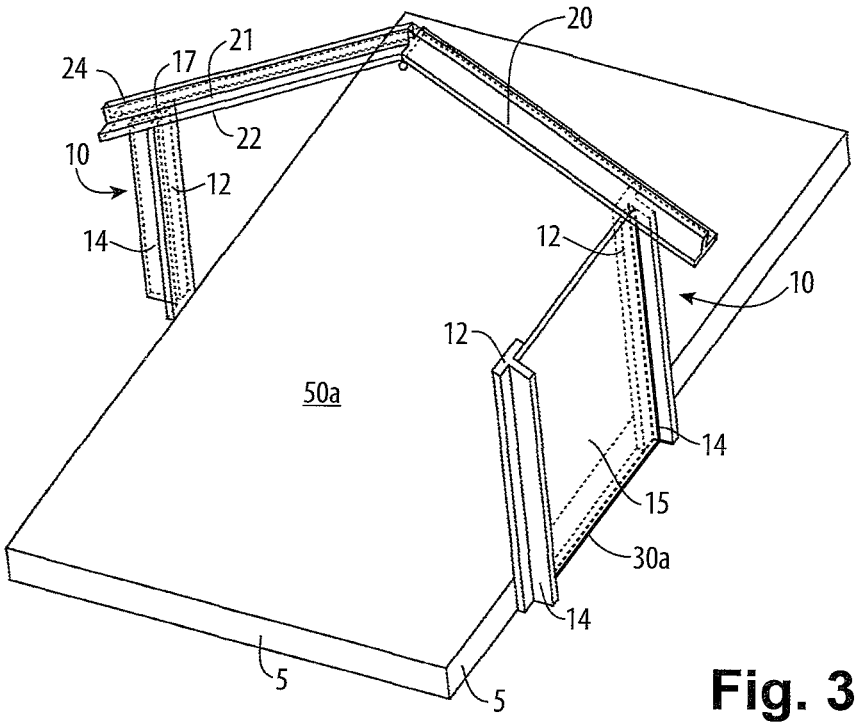
FIG. 30 is a perspective diagrammatic view showing the platform and uprights of FIG. 29, and also includes a pair of rafters with each secured to an opposing pair of the T-shaped uprights, where the apex of each of the two rafters are pivotally joined together by a piano hinge, which helps support the two rafters in a triangular shape.

The components of the modular house shelter unit 1, include namely a foundation 4 (which may be concrete), pier footings 5 (which may be made of concrete), circumferentially extending exterior rim frame joists/girders 6, parallel interior floor beams 52 supporting insulated floor panels 50, to form a complete floor 50*a*, (as shown in FIG. 30), a plurality of upright wall joists 10 with lengthwise extending base legs 12 and lengthwise extending outstanding web legs 14 protruding outwardly exterior wise away from the base leg 12, wall panels 30 nesting between the wall joists, and a roof that includes a plurality of pairs of roof rafters 20; each roof rafter 20 formed with a T-shaped cross-section having a base leg 22 and an outstanding web leg 24 protruding inwardly into the structure being built and away from the base leg of the rafter 20, which are connected by removable fasteners 80 within pre-drilled fastener holes 82.

FIG. 10 shows wall panels 30 nesting in place in spaces 15, extending between two adjacent uprights 10, at the respective corners 16, 18 between the respective pairs of base leg 12 and protruding perpendicular leg 14 of pairs of uprights 10. FIG. 10A shows details of the connections of the lower portions 12*b* of uprights 10, with the circumferentially extending framing joists/girders 5 extending up from the concrete or other earthenware foundation 4.

Preferably the removable fasteners 80 are a plurality of removable screws threadably fastened within pre-drilled holes 81; wherein one or more of the plurality of screws 80 are configured to releasably secure a first side of each wall panel 30 to a base leg 12 of a first one of the adjacent pair of uprights 10; and one or more of the plurality of screws 80 are configured to secure a second side of each wall panel 30 to each respective base leg 12 of a second one of the adjacent pair of uprights 12. Also, one or more of the plurality of removable screws 80 are used to releasably secure a first side of each roof panel 40 to a base leg 22 of a first one of the adjacent pair of roof rafters 20, 21; and one or more of the plurality of removable screws 80 are configured to removably secure a second side of each respective roof panel 40 to the respective base leg 22 of a second one of the adjacent pair of the roof rafters 20, 21.

Figure 2:
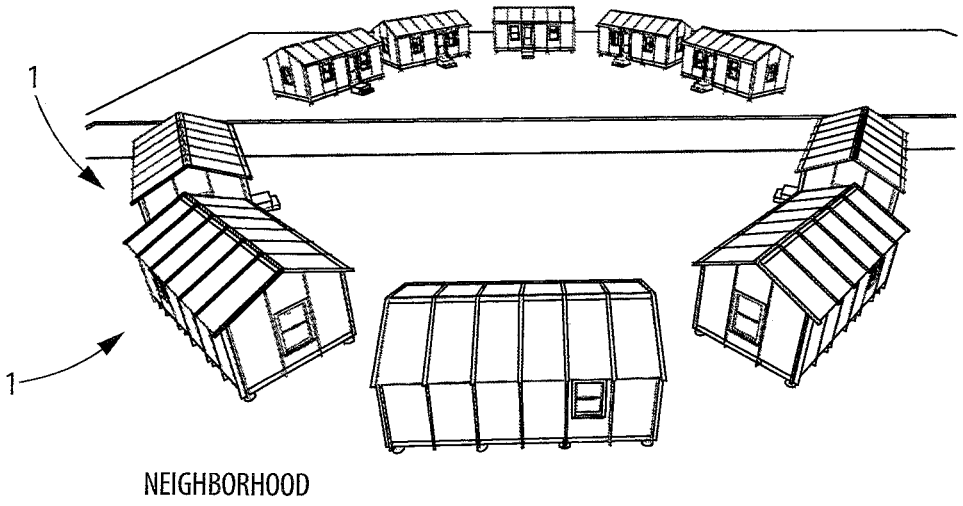
FIG. 2 is a perspective view of a plurality of the rapidly deployable housing shelters shown assembled in a circular configuration.
Figure 3:
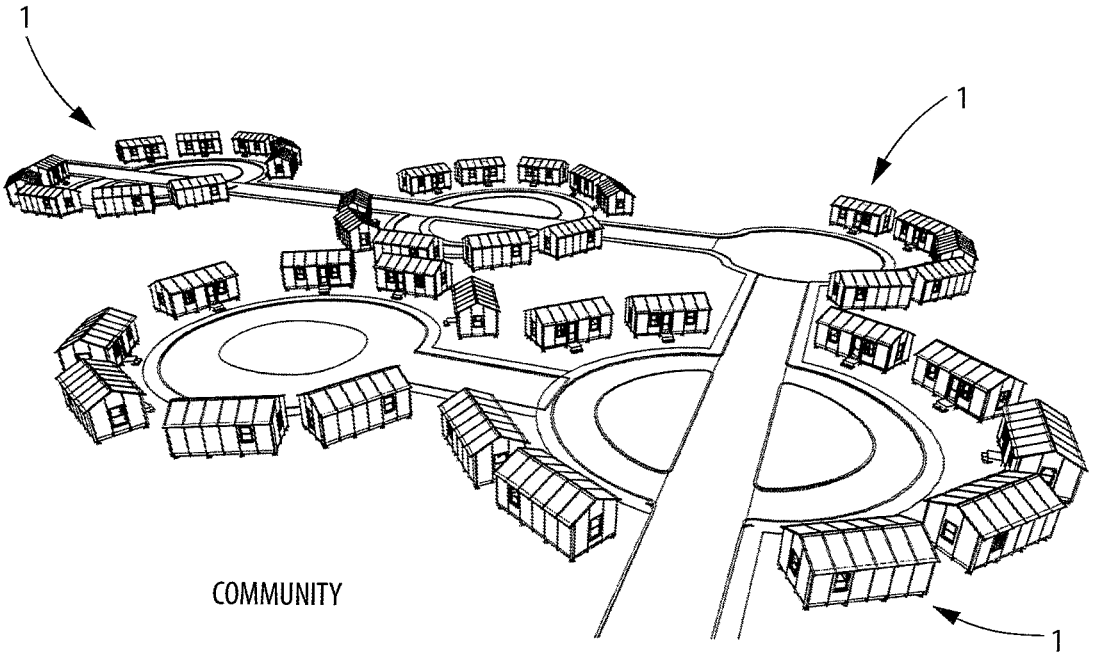
FIG. 3 is a perspective view of a set of the rapidly deployable housing shelters positioned in a plurality of cul-de-sacs.

FIG. 1 shows a rapidly deployable housing shelter unit 1. When multiple units are needed at a recent disaster site, FIG. 2 shows that a plurality of the rapidly deployable housing shelter units 1 may be assembled in an optional circular configuration. FIG. 3 shows a set of the rapidly deployable housing shelter units 1 positioned in a plurality of optional cul-de-sac groups.

Figure 4:
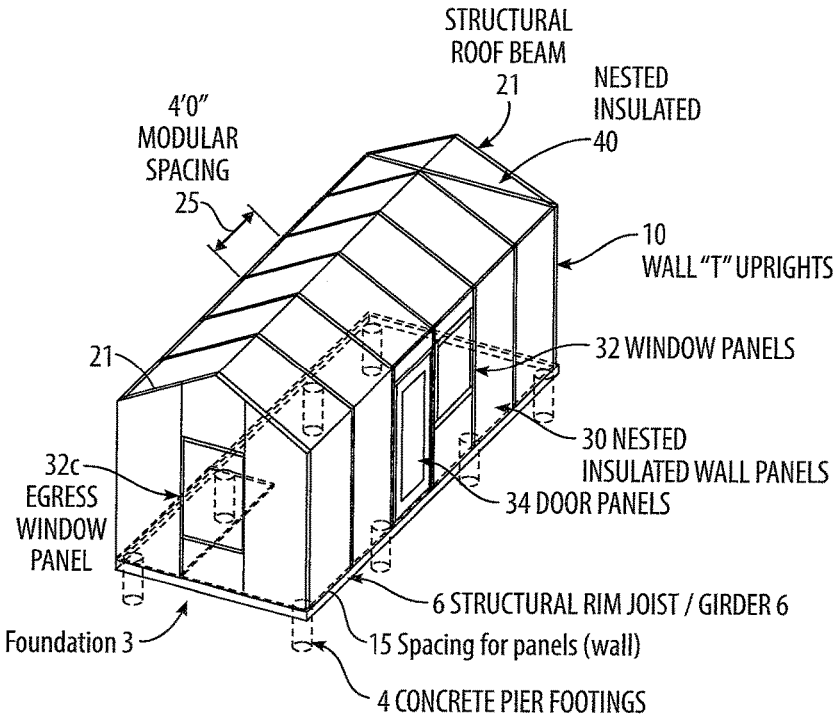
FIG. 4 is a transparent perspective view of the framing of the rapidly deployable housing shelter unit of FIG. 1.
Figure 13:
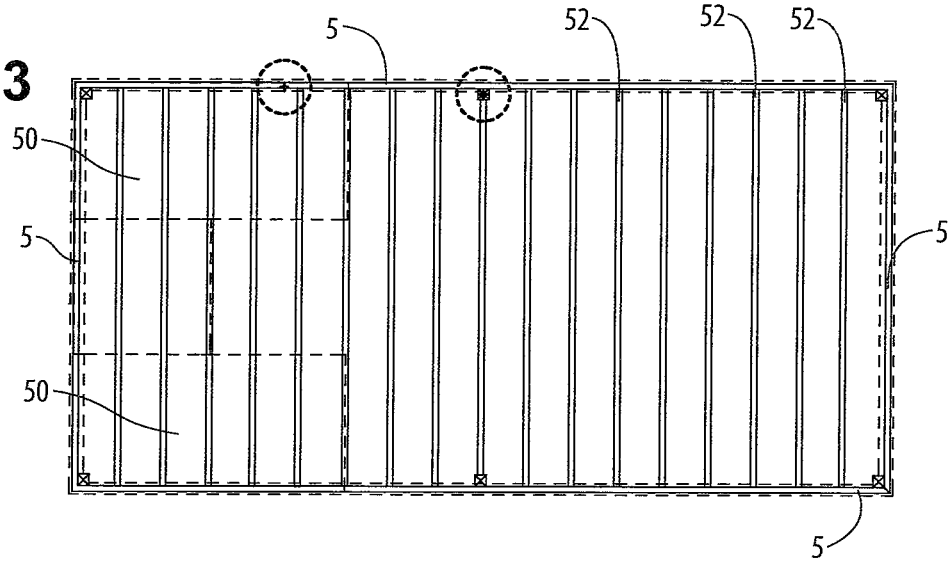
FIG. 13 is a top plan view of the floor framing the for the rapidly deployable housing shelter of FIG. 1.
Figure 13A:
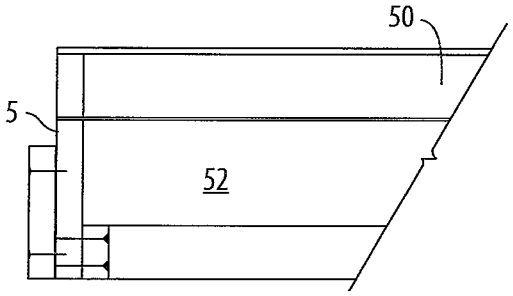
FIG. 13A is an enlarged detail view of a portion of the floor framing shown in FIG. 13.
Figure 14:
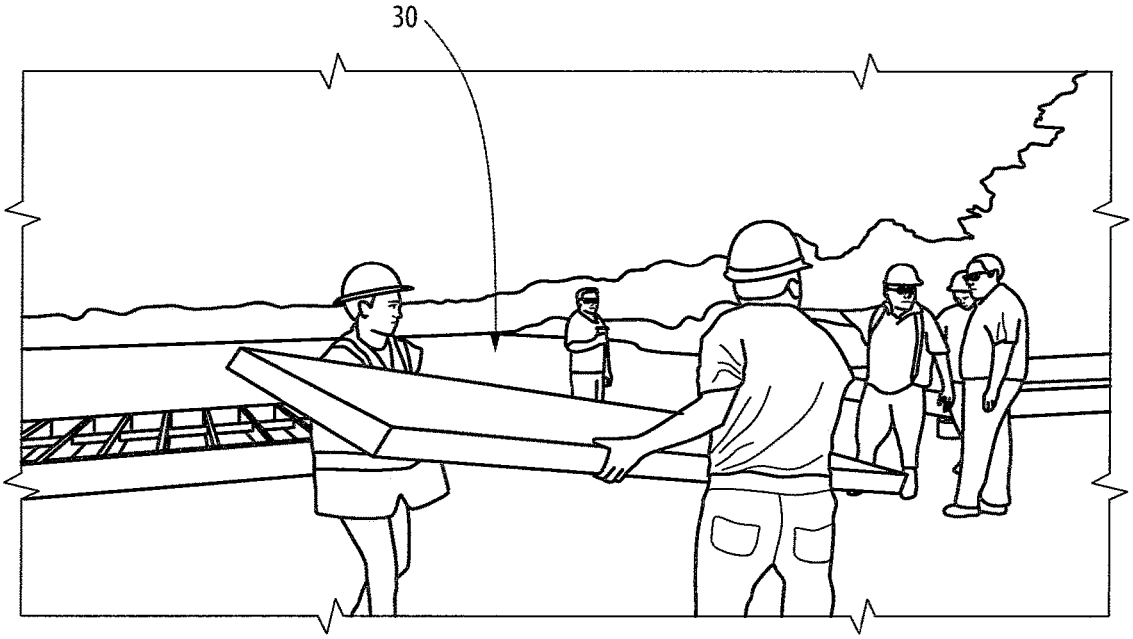
FIG. 14 is a perspective view showing workers carrying a wall panel for the housing shelter of FIG. 1.
Figure 15:
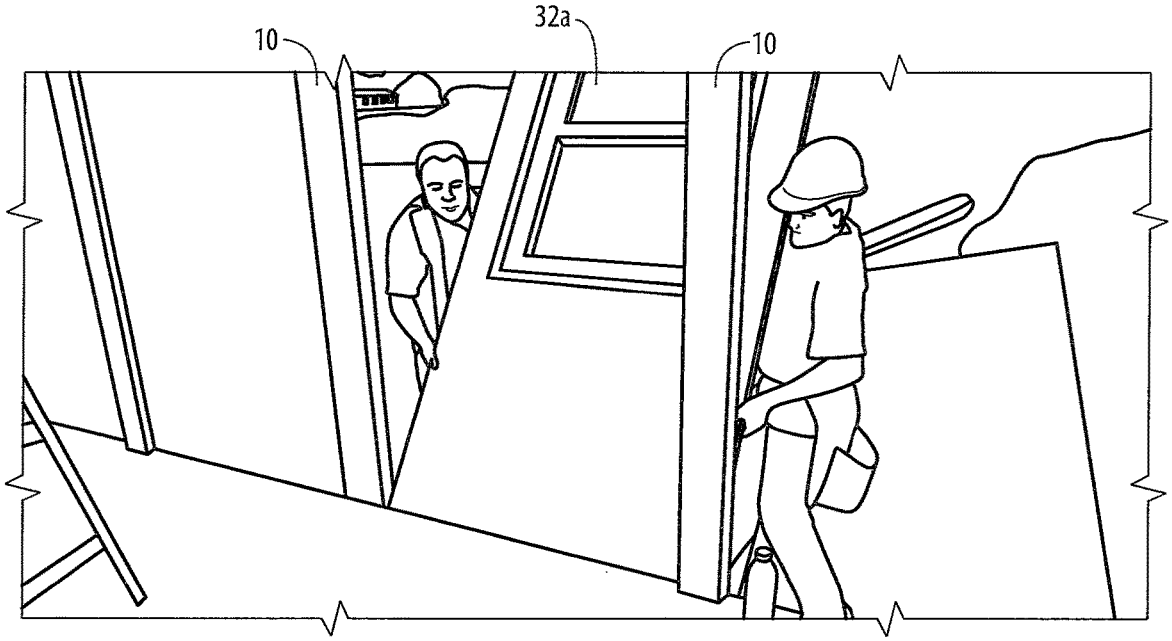
FIG. 15 is a perspective view of the two workers nesting a wall panel between the perpendicularly extending portions of two adjacent T-shaped uprights.
Figure 16:
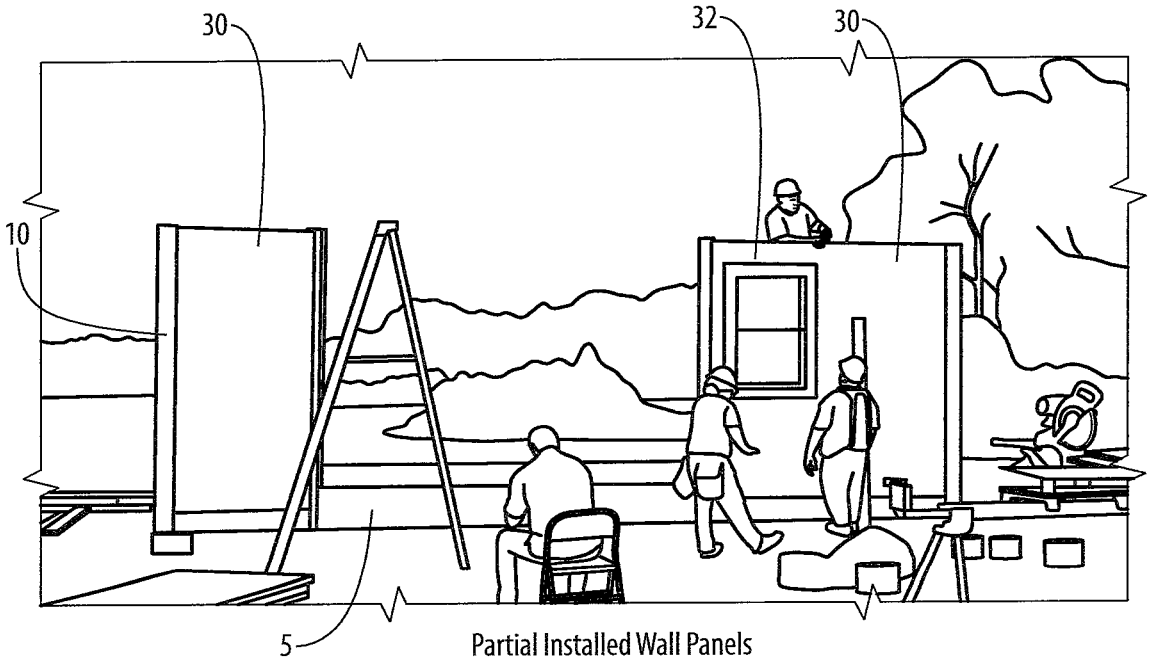
FIG. 16 is a perspective view showing installation of several wall panels in place between adjacent T-shaped uprights.
Figure 17:
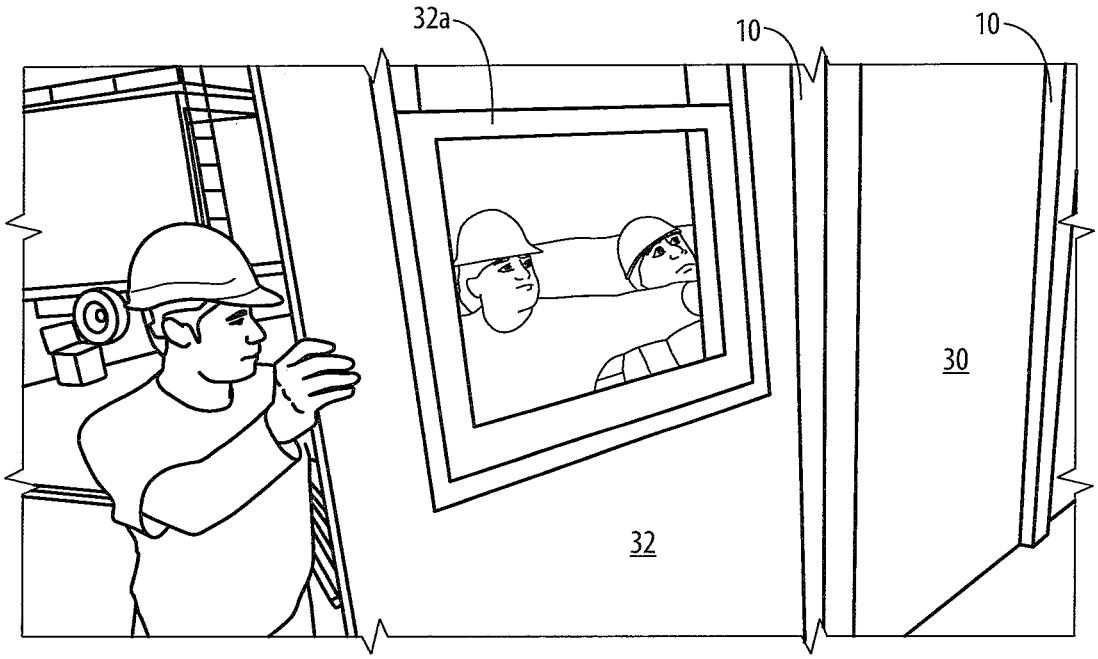
FIG. 17 is a perspective view of the inside of the housing shelter unit of FIG. 1 as it is being assembled, showing a worker installing a wall panel with a window between adjacent T-shaped uprights.

FIG. 4 shows a transparent view of the framing of the rapidly deployable housing shelter unit 1, including concrete pier footings positioned in the ground or other ground support area, circumferentially extending structural rim joist/girders 6, supporting parallel rows of floor beams 52 (as shown in FIG. 13), upon which are removably fastened floor panels 50. FIGS. 4 and 10 also depict structural wall uprights 10, nested insulated wall panels 30 nesting in modular spacing 15 against corners 16, 18 located between adjacent base legs 12 and perpendicularly outwardly extending web legs 14 of the wall uprights 10, door panel 34, window panels 32, with windows 32*a*, an egress window 32*c*, each within respective wall panels 30, 32, structural roof beam rafters 20, 21, joined by connector 44, without the need for a roof ridge beam therebetween, and roof panels nested in modular spaces 25 against corners 26, 28 located between base legs 22 and perpendicular adjacent outwardly extending web legs 24 of the roof rafters 20 and 21.

Figure 5:
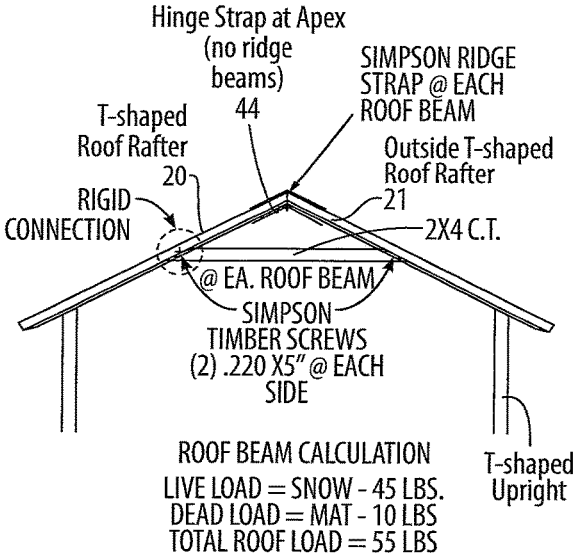
FIG. 5 is a front elevation view of the T-shaped uprights and roof rafters in place in the housing shelter unit of FIG. 1.
Figure 6:
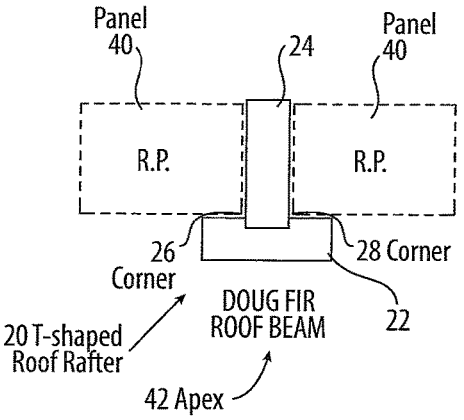
FIG. 6 is an enlarged cross-sectional view of a T-shaped upright of the housing shelter unit of FIG. 1, showing adjacent portions of nested wall panels in dashed lines.
Figure 7A:
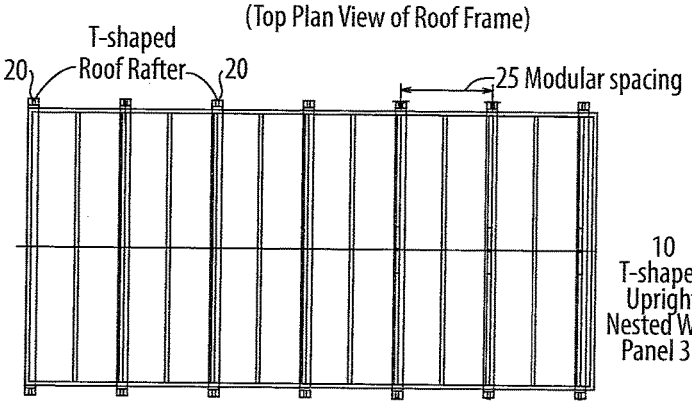
FIG. 7A is a top plan view of the rapidly deployable housing shelter unit of FIG. 1.
Figure 7C:
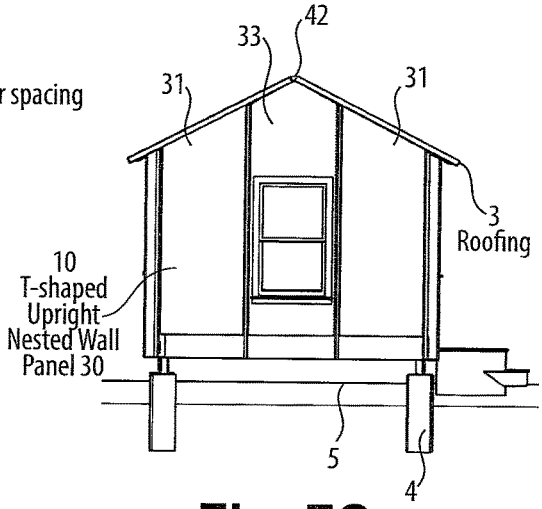
FIG. 7C is a first end view of the rapidly deployable housing shelter unit of FIG. 1.
Figure 7B:
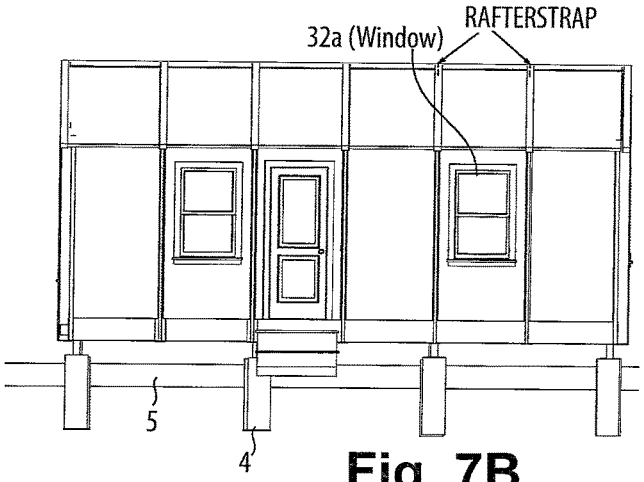
FIG. 7B is a front view of the rapidly deployable housing shelter unit of FIG. 1.
Figure 7D:
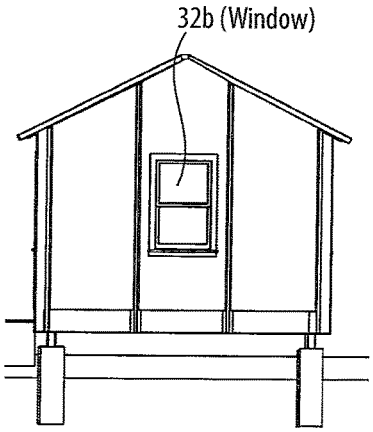
FIG. 7D is a second end view of the rapidly deployable housing shelter unit of FIG. 1.

FIG. 5 shows details of an end view of the roof 3 showing T-shaped roof rafters 20, 21, meeting at apex joint 42, without the necessity of an extended roof ridge beam extending across the length of the roof between roof rafters 20, 21. Rafters 20, 21 are directly connected to each other. FIG. 5 shows roof rafters 20, 21 connected to uprights 10 via the angled notch 17 in the respective T-shaped roof rafters, wherein a portion 20*a*, 21*a* of each roof rafter 20, 21 contains the respective notches 17, 17 engaging upper portions of respective pairs of T-shaped uprights 10 therein, at a point about one foot from the distal end of roof rafters 20, 21, whereby a roof overhand tail to direct rain water away from the housing shelter unit 1 is provided by the one foot overhang 29 of each roof panel 40, 40 nesting in the modular spacings 25, 25 against corners 26, 28 located between base legs 22 and perpendicular adjacent outwardly extending web legs 24 of the roof rafters 20 and 21.

As also shown in drawing FIGS. 1-11 and 14-28, the facades 2*a*, 2*b*, 2*c*, 2*d* of housing shelter units 1 are comprised of weatherproof and shockproof wall panels 30 nesting between the T-shaped uprights and the roofs 3 are comprised also of weatherproof and shockproof roof panels 40 resting between the T-shaped roof rafters. The wall panels 30 nest within spacings 15 between adjacent T-shaped uprights, preferably made of lumber wood or synthetic simulated wood appearing materials, like AZEK®. Polyurea coating of the foam filled panels make them waterproof, weatherproof, windproof, airtight and mold resistant without requiring separate roofing or siding. Likewise, the roof panels 40 nest within spacings 25 between adjacent T-shaped roof rafters, also preferably made of lumber wood, or synthetic simulated wood appearing materials, like AZEK®. Polyurea coating of the foam filled roof panels make them waterproof, weatherproof, windproof, airtight and mold resistant without requiring separate roofing or siding.

As shown in drawing FIGS. 6-10, the T-shaped uprights are vertical support posts which form the spaced-apart nesting regions 15 respectively for the wall panels. The T-shaped rafters 20, 21 are angularly positioned roof rafters which faun the spaced-apart nesting regions 25 for nesting of the roof framing panels 40. The T-shaped vertically extending uprights 10 are constructed with a cross sectional 90-degree configuration with a base leg 12 having opposite flanges on each side of the outwardly protruding, perpendicular extending central web leg 22, to accommodate the nesting of the wall panels 30 in the modular spacing 15 between adjacent T-shaped uprights 10 which, along with a weatherproofing strip 19, prevent water intrusion and does not allow any water to flow down along the exterior channel of uprights 10.

To further inhibit water intrusion, a small bottom portion of between six and fifteen inches, preferably twelve inches, of the bottom length of the wall panels 30, extends down below the height of the floor panels 50, so that no water will seep below the bottom of each wall panel into the floor of the housing shelter unit 1. It is noted that the floor panels are similar in material and configuration to the wall and roof panels 30, 40, in that each foam filled panel, whether it be wall, roof or floor panels are each about two to three inches in thickness. The wall and roof panels are preferably thirty inches wide and eight feet in length, but the floor panels can have a smaller width and horizontal length than the wall panels 30 and roof panels 40. It is also noted that the wall panels of the front and rear facades 2*a* and 2*b*, as well as the roof panels 40 are rectangular with dimensions of thirty inches in width by eight feet in length, with a thickness of between two and three inches. However, for the left and right end facades 2*c* and 2*d*, the 8-foot by 30-inch wall panels have cutouts to accommodate the triangular gable shape of the ends of each housing shelter unit 1. For example, the end wall panel 30 in the middle of the gabled sides will have an angled, equal sided peaked top portion, but the adjacent side wall panels 30, 30 will have an angular portion of opposite angles, depending upon which side of the middle panel 30 they are located adjacent to.

The wall panels shown in FIGS. 1-4, 7, 9, 10, 14, 15, 16, 17 and 24, each have a bottom edge which is located below the flooring inside of the housing shelter, thereby preventing any water intrusion below the panel into the interior flooring of the housing shelter.

As shown in FIGS. 4, 5, 8, 11, 11A, 19, 20, 21, 22, 23, 24 and 27, the roofing panels 40, which may be identical to the wall panels 30, except for windows 32 or doors 35 on some of the wall panels 30, slide in place between adjacent T-shaped rafters 20, 21, forming a gable roof 3.

Figure 23:
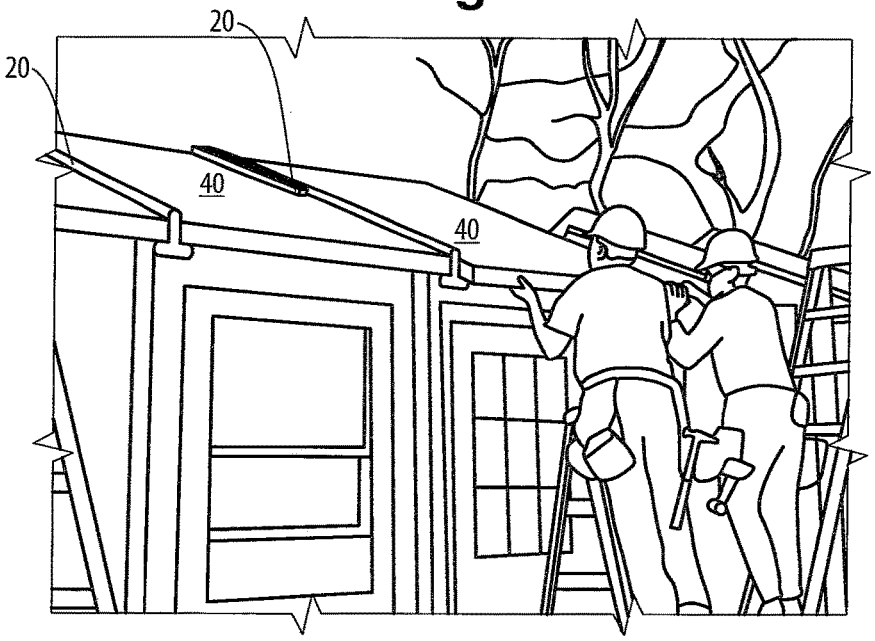
FIG. 23 is a perspective view showing two workers sliding a roof panel in place between adjacent T-shaped roof rafters.
Figure 24:
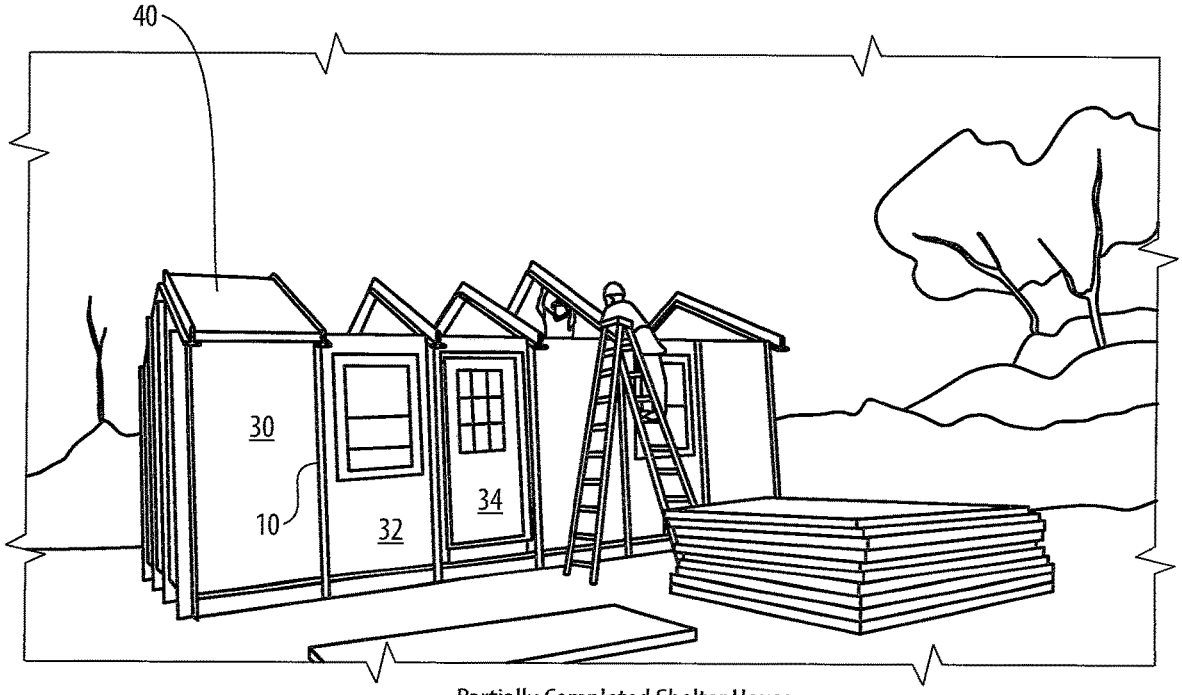
FIG. 24 is a perspective view showing a partially assembled shelter unit.
Figure 25:
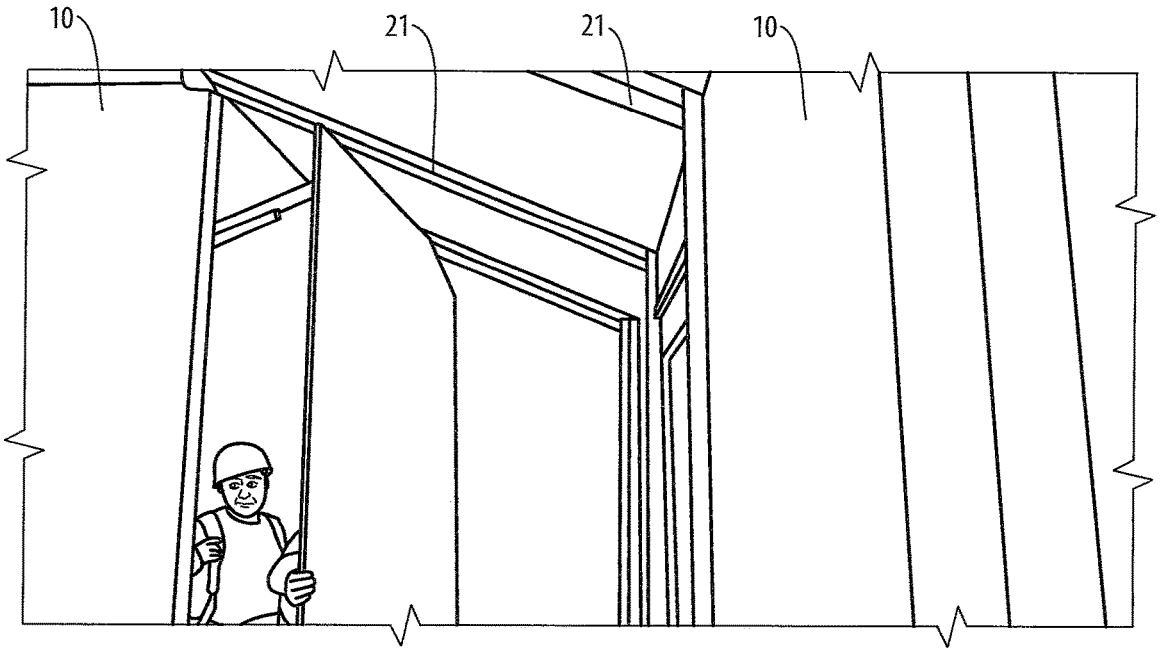
FIG. 25 is an interior view of the partially assembled rapidly deployable housing shelter unit.
Figure 26:
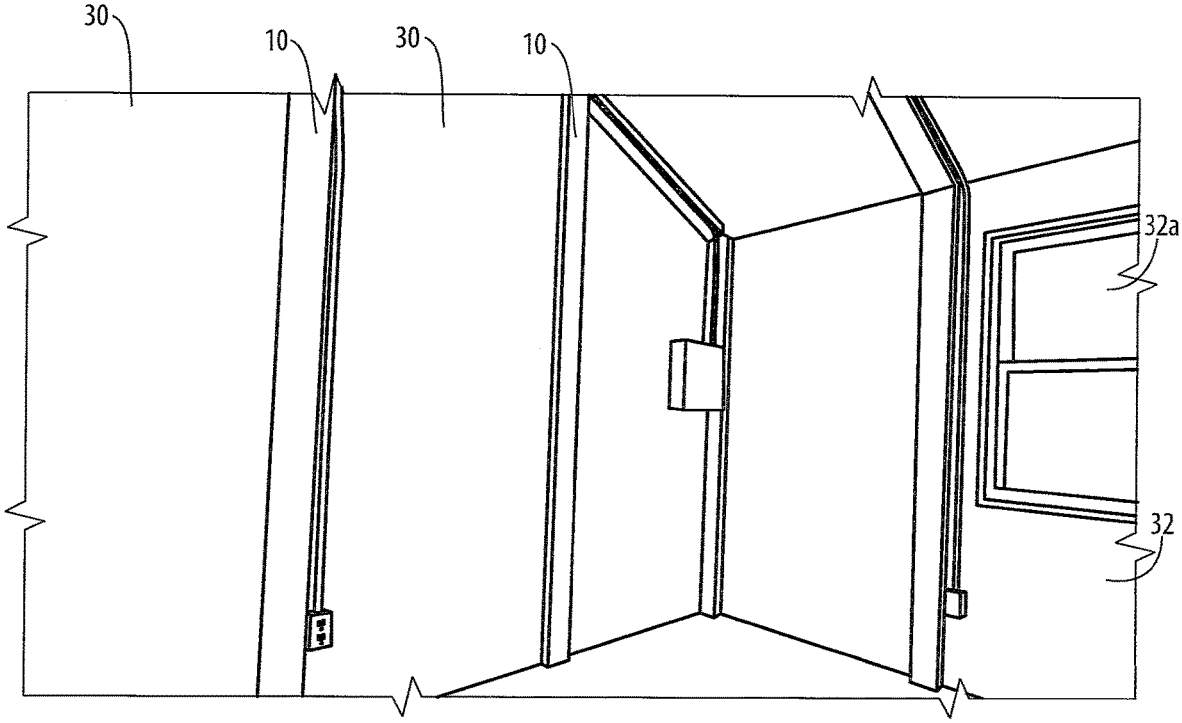
FIG. 26 is an interior view of the assembled rapidly deployable housing shelter unit showing electrical wiring deployed from templates to the T-shaped uprights located inside the walls of the rapidly deployable housing shelter units.
Figure 27:
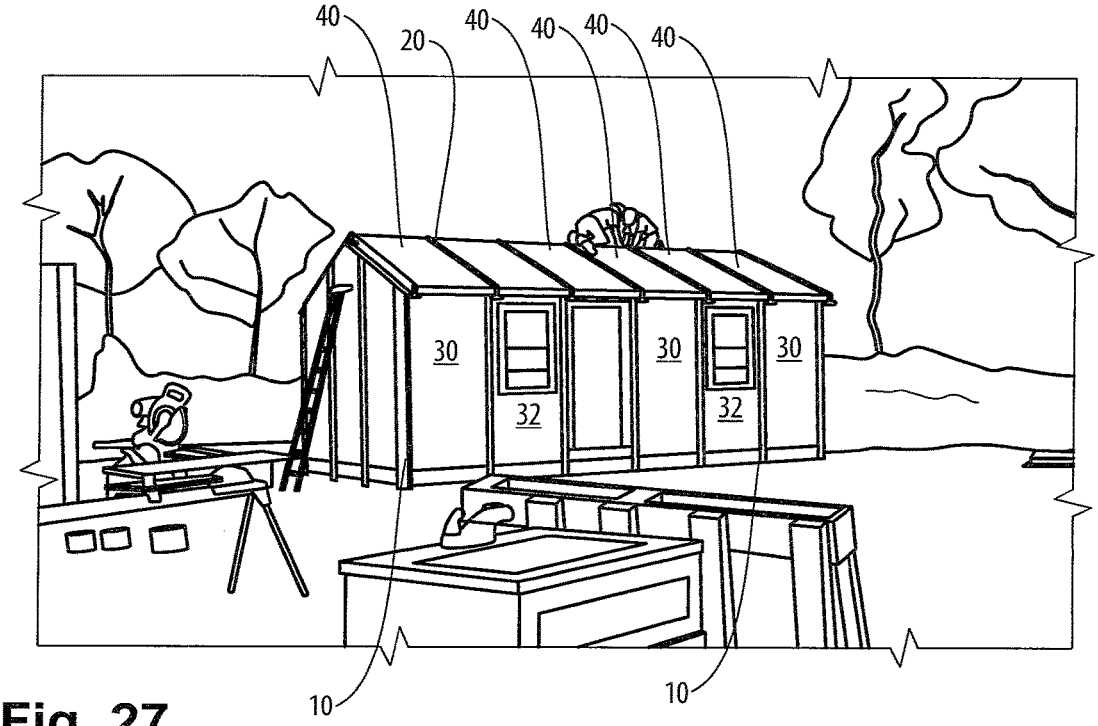
FIG. 27 is a perspective view of the e housing shelter unit during the final assembly stage.
Figure 28:
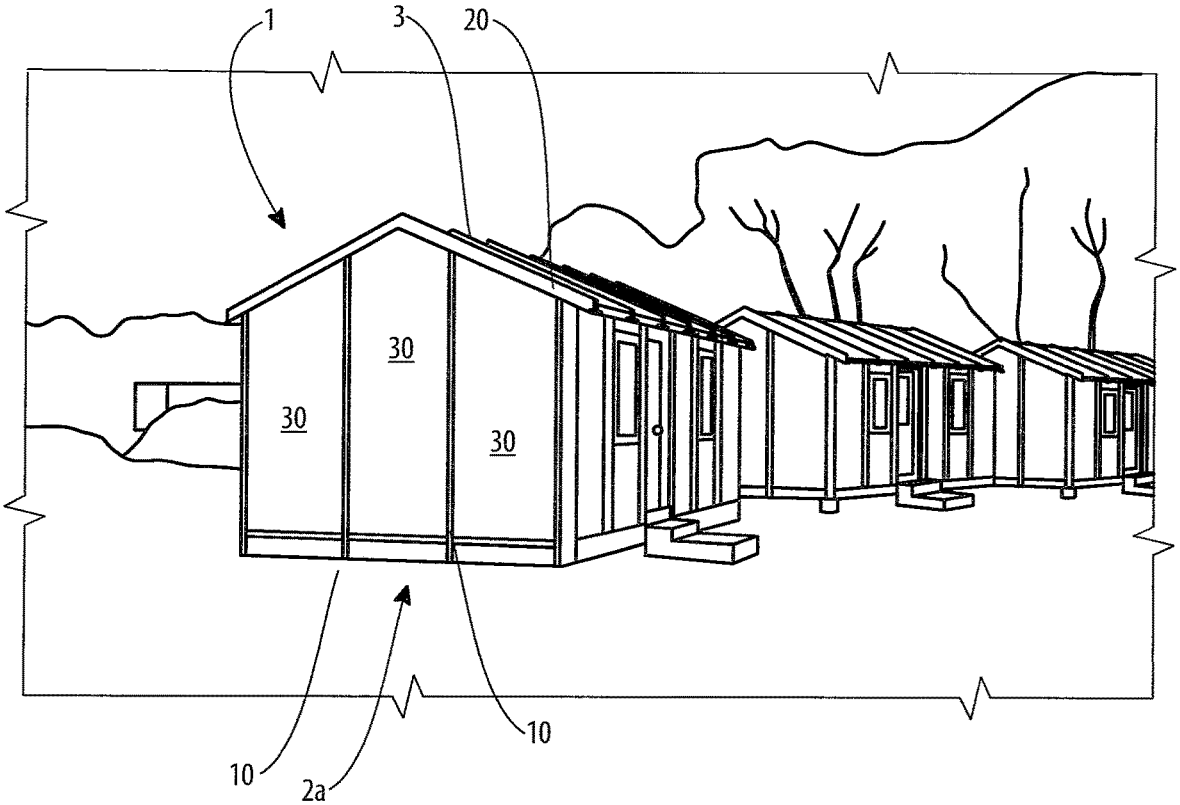
FIG. 28 is a perspective view of a plurality of the rapidly deployable housing shelter unit of FIG. 1.

FIG. 23 shows a roofing panel 40 being slid in place between two adjacent T-shaped roof rafters 20, 21.

Figure 8:
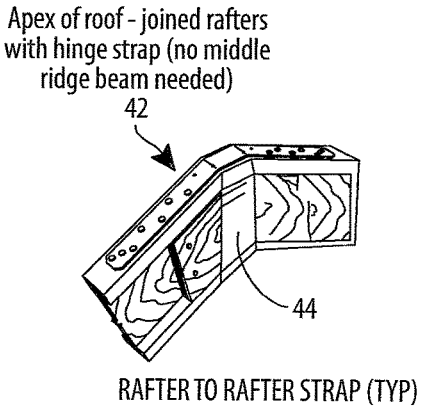
FIG. 8 is a close up detail perspective view of the central joining point of two roof rafters joined directly together without an intervening spanning ridge beam.
Figure 7E:
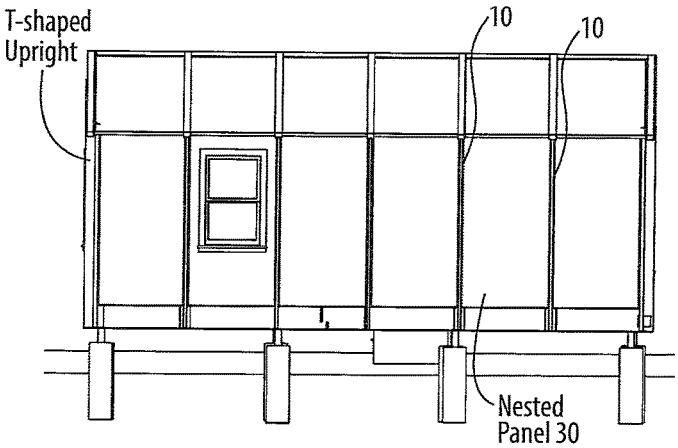
FIG. 7E is a rear view of the rapidly deployable housing shelter unit of FIG. 1.
Figure 11:
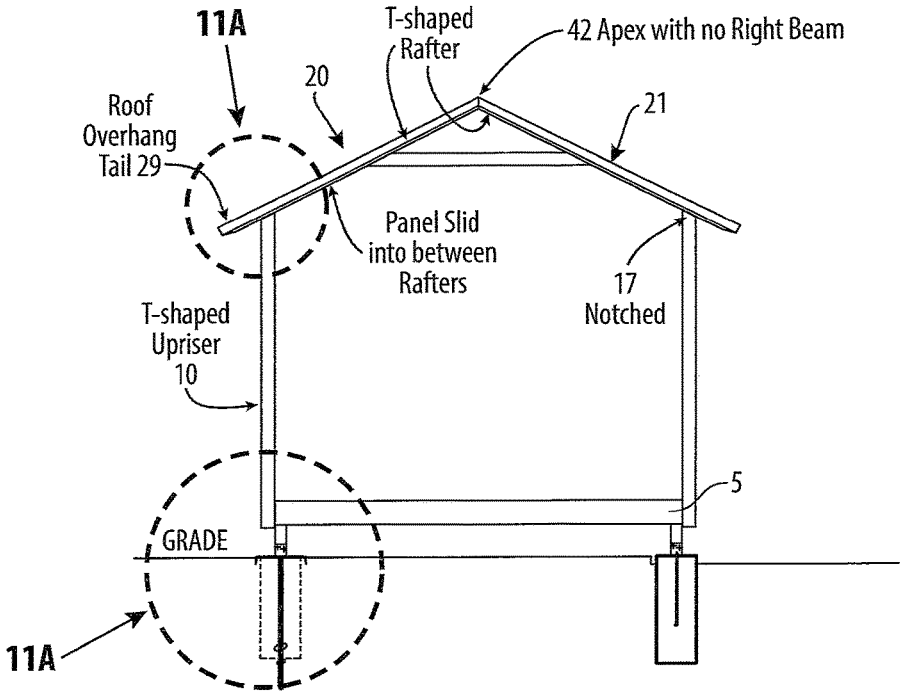
FIG. 11 is a front view showing the T-shaped rafters meeting the T-shaped uprights.
Figure 11A:
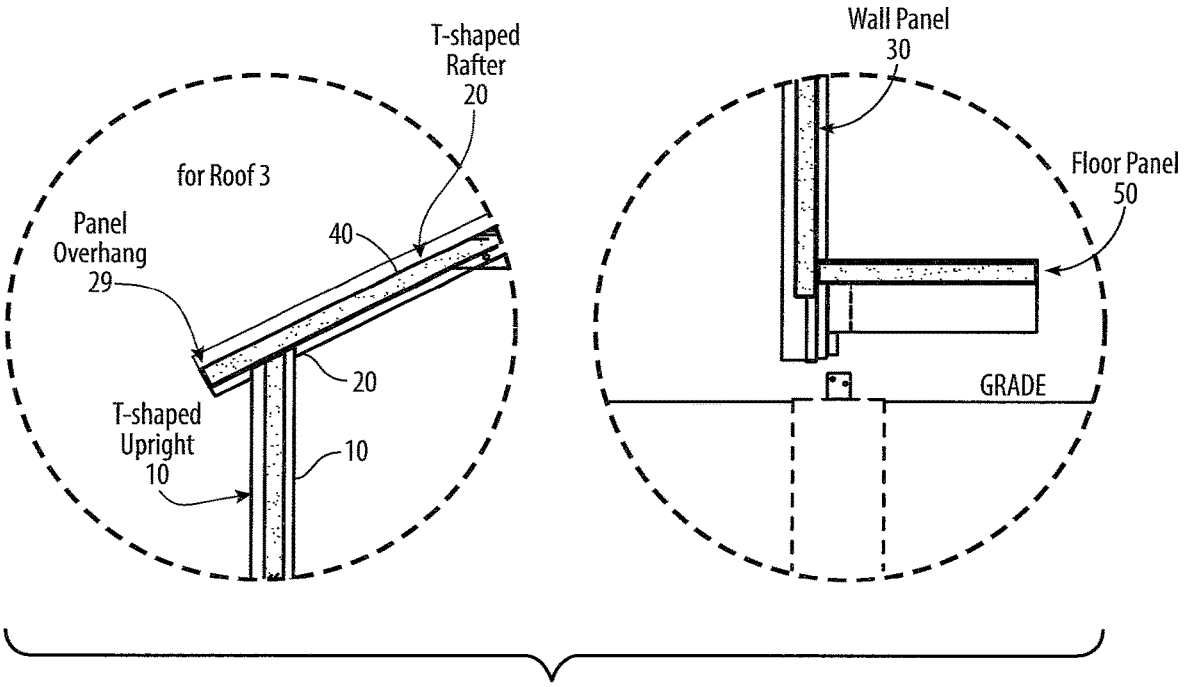
FIG. 11A is a close-up detail view showing one of the roof rafters attached removably to a T-shaped upright wherein the distal end portion of the roof panel extends outwardly to provide the roof overhang tail.
Figure 20:
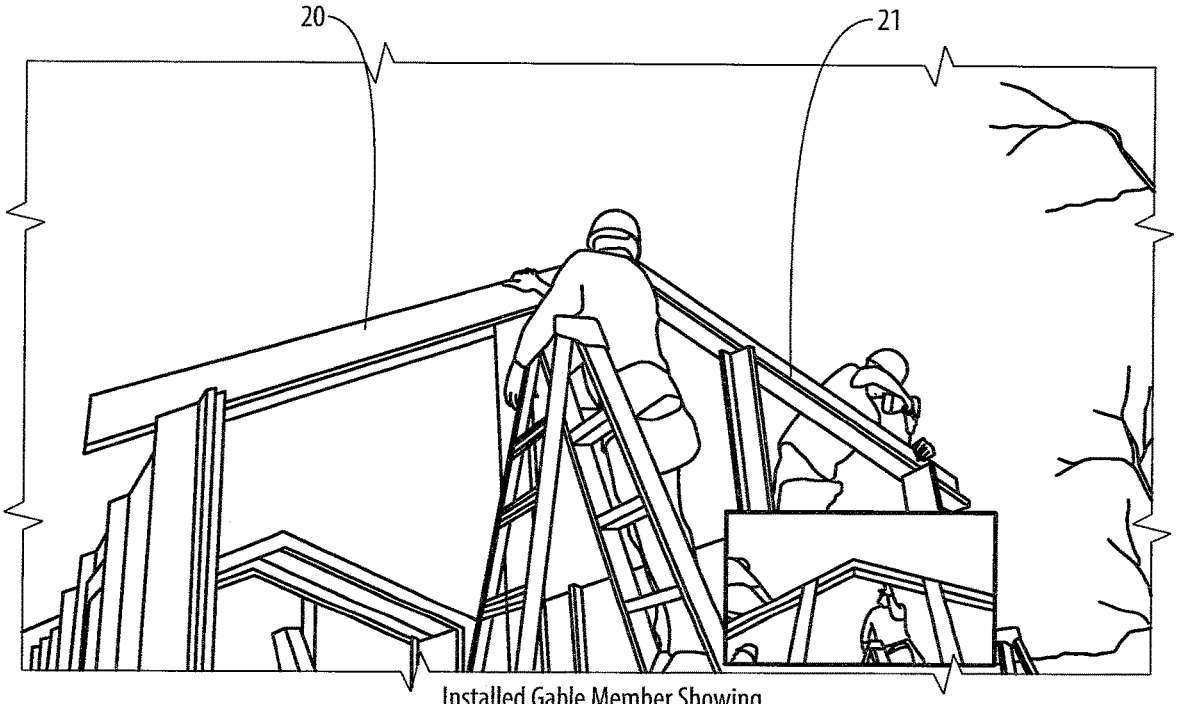
FIG. 20 is a perspective view showing joining by worker of two roof rafters such that they are directly contacting each other at the apex of the roof gable.
Figure 21:
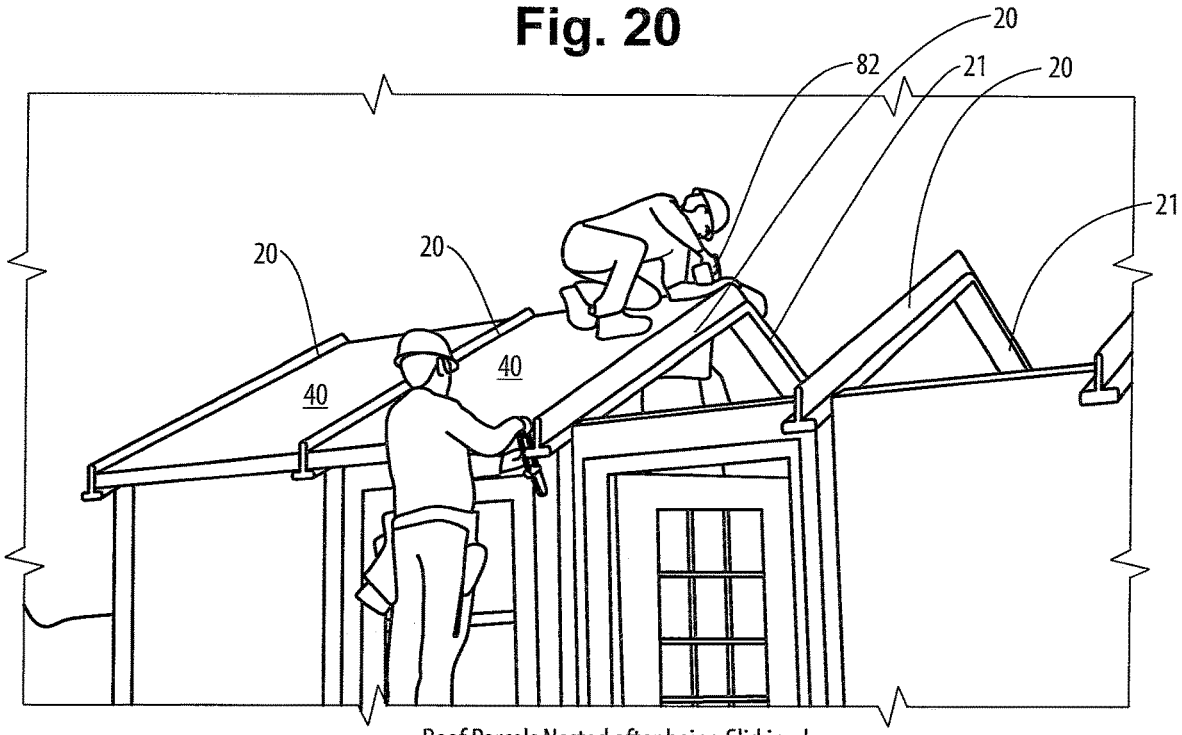
FIG. 21 is a perspective view of roof panels being installed between adjacent T-shaped roof rafters.
Figure 22:
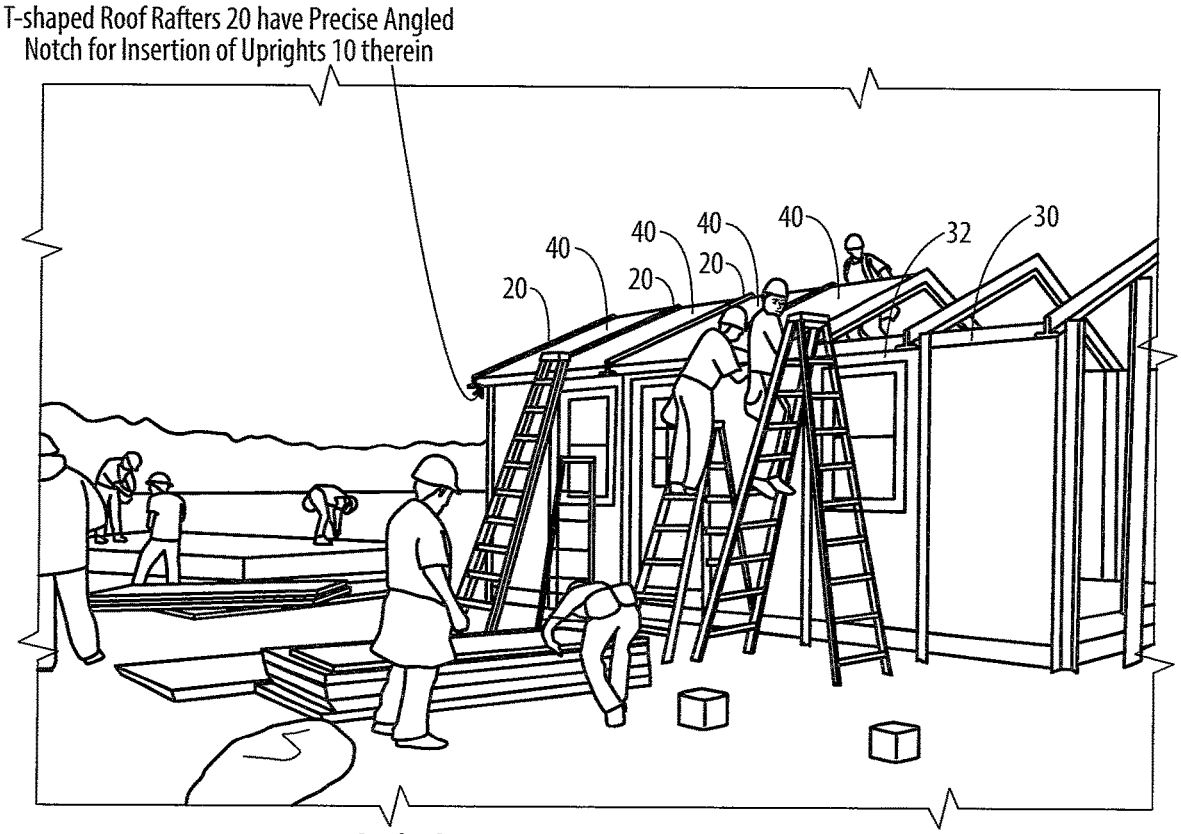
FIG. 22 is a perspective view of showing a partially assembled shelter unit.

As shown in FIGS. 8, 11, and 20, the hinged corner of the apex peak 42 of pairs of joined T-shaped rafters 20, 21, pivotably joined by roof hinge strap 44, forming the roof framing, facilitates easy installation and folds flush for shipping. As also shown in FIGS. 8, 11 and 20, the T-shaped roof rafters 20, 21 adjoin each other end to end at apex peak 40, without the necessity of being joined with a separate conventional ridge plank between the two distal ends of the T-shaped roof rafters 20, 21, so that the hinged part of the T-shaped rafters 20, 21 touch each other directly.

Figure 11B:
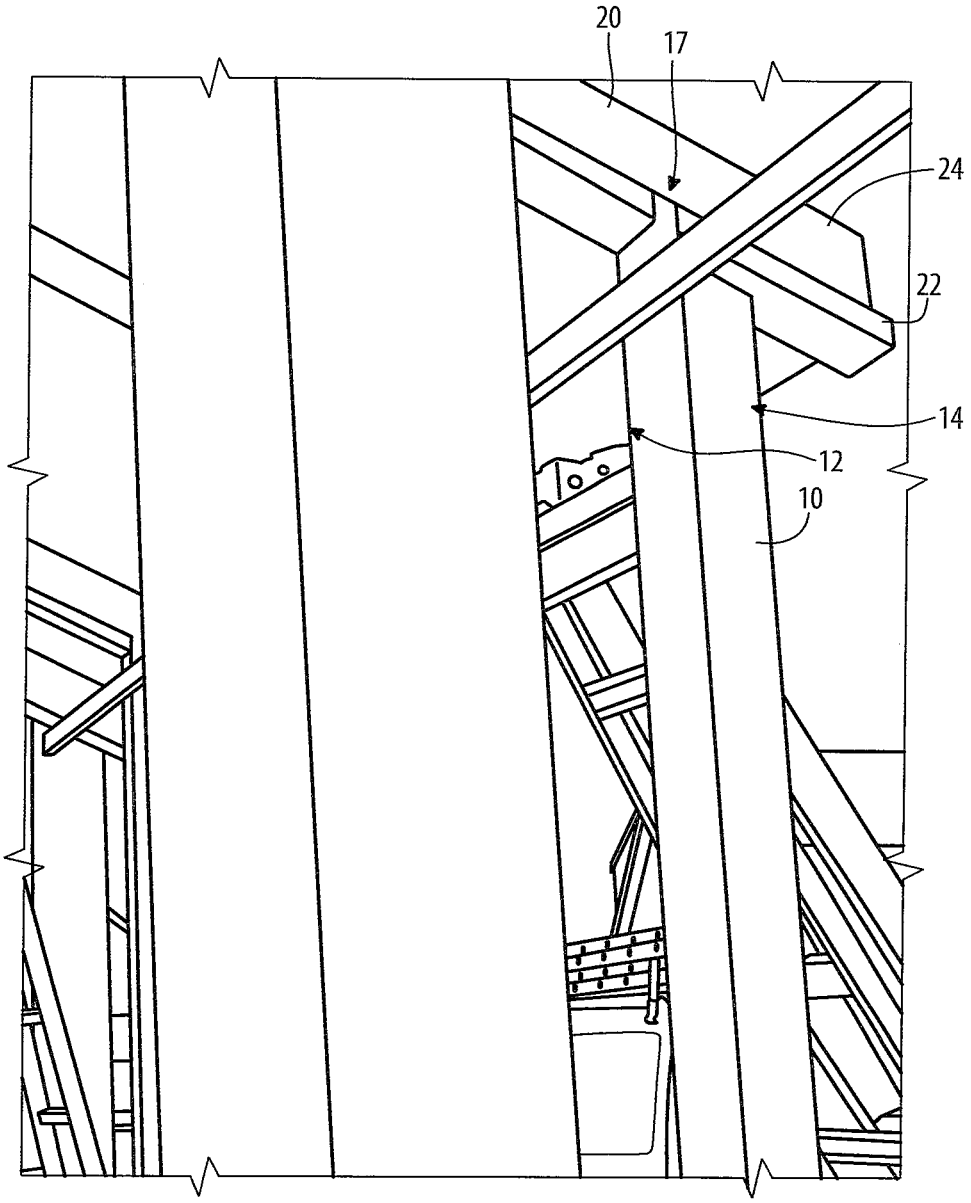
FIG. 11B is a close-up detail view showing the top portion of the base leg of a T-shaped upright snugly fitting within an angled notch of a portion of the base leg of a T-shaped roof rafter, wherein the angle corresponds to the angle of the roof.
Figure 11C:
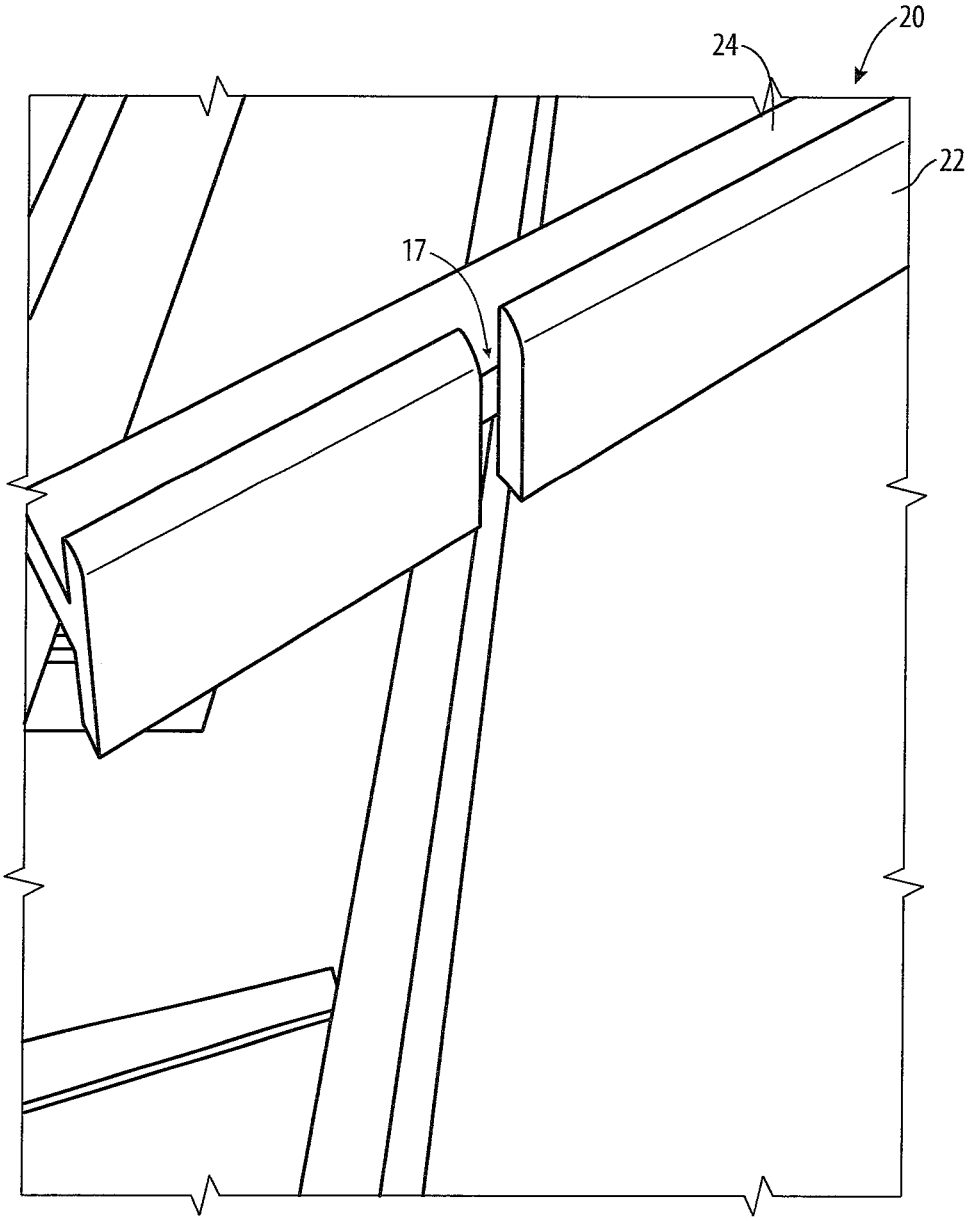
FIG. 11C is a close-up detail of a roof rafter before installation, showing the angled notch of the distal portion of the T-shaped roof rafter, wherein the angle of the notch corresponds to the angle of the roof.
Figure 12:
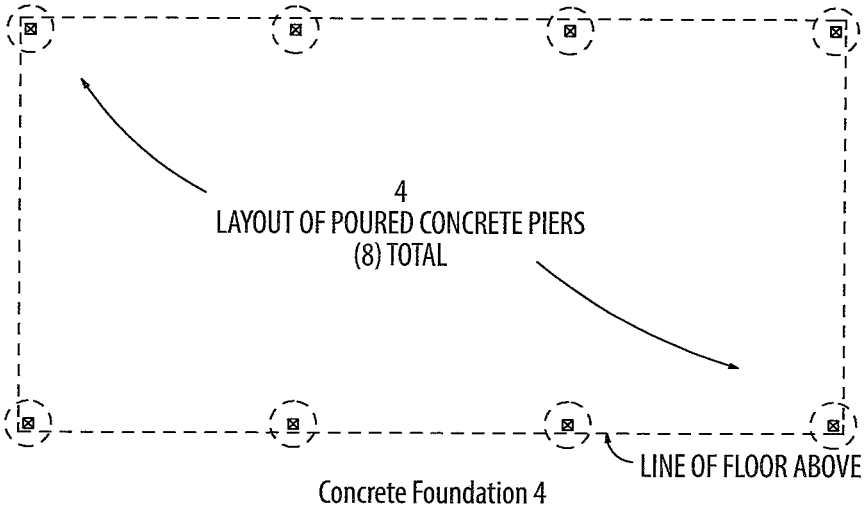
FIG. 12 is a top plan view of the concrete foundation for the rapidly deployable housing shelter unit of FIG. 1.

As shown in FIGS. 11, 11A, 11B and 11C, the T-shaped roof rafters 20, 21 have a portion 20*a*, 21*a* containing notches 17, engageable with an upper portion of adjacent T-shaped uprights 10, 10 at the point of connection to the vertical walls formed by the T-shaped uprights 10 and wall panels 30, for connecting together and for easy installation and alignment. Optionally, the T-shaped vertical wall panels 30 could have a notch (not shown) to accommodate roof rafters 20, 21 therein, at the point of connection with the upper part of the T-shaped uprights. FIG. 11B shows the top portion of the base leg 12 of a vertically extending T-shaped upright 10 snugly fitting within the angled notch 17 of a distal portion of the base leg 22 of a T-shaped roof rafter 20 or 21, wherein the angle of the notch 17 corresponds to the angle of the roof 3. FIG. 11C is a close-up detail of a roof rafter 20, 21 before installation, showing the angled notch 17 of the distal portion of the base leg 22 of the T-shaped roof rafter 20, 21, wherein the angle of the notch 17 corresponds to the angle of the roof 3.

Figure 18:
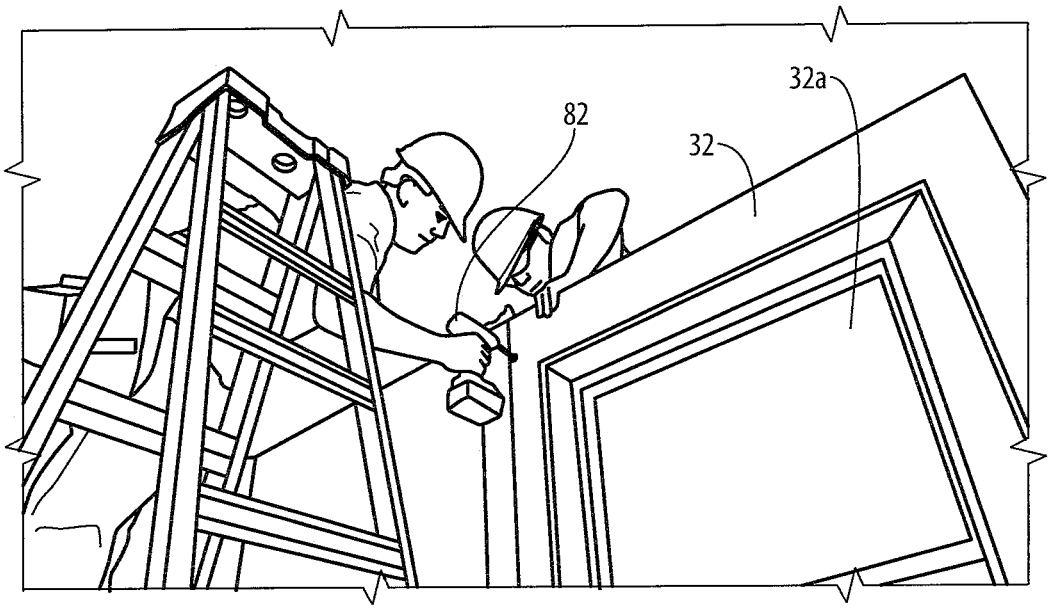
FIG. 18 is a perspective view looking upwards at two workers attaching a wall panel to T-shaped uprights with removable fasteners in pre-drilled holes.
Figure 19:
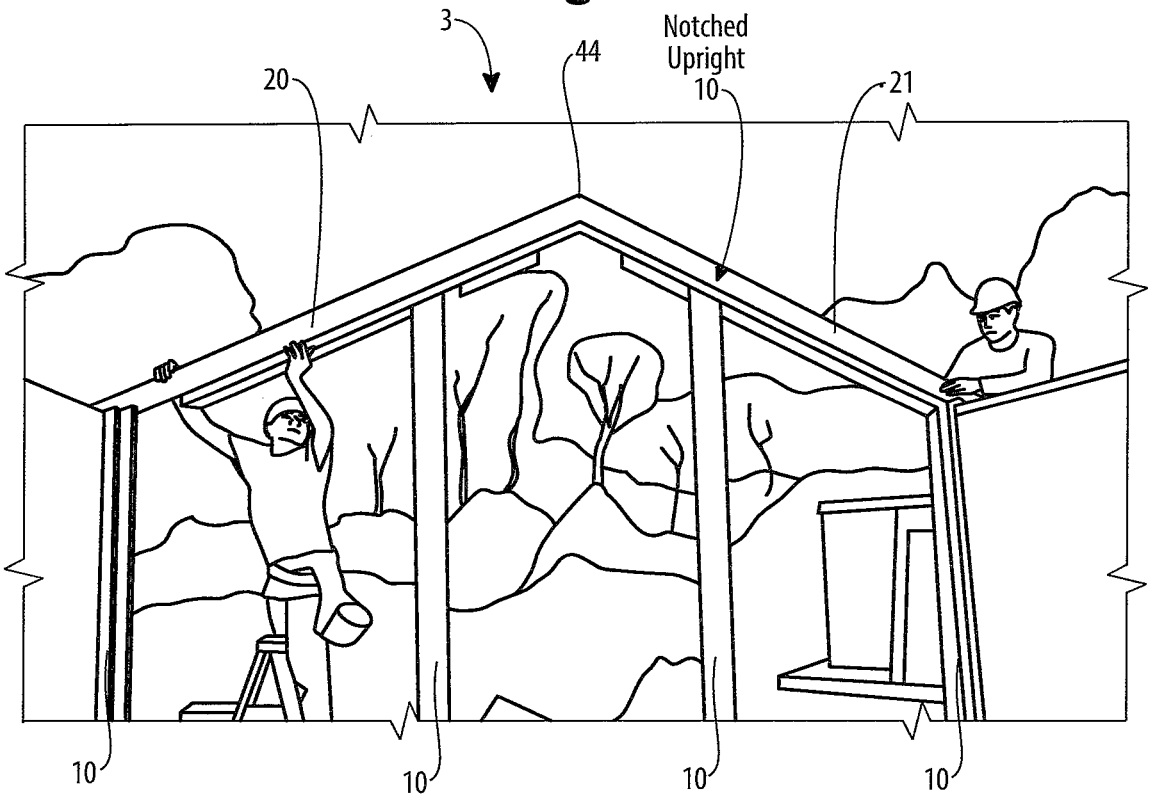
FIG. 19 is a perspective view of workers installing a T-shaped roof rafter.

As shown in FIGS. 18 and 19, each housing shelter 1 assembles and disassembles with only a hand-held power fastener gun 82 for inserting removable fasteners, such as screws 80 into predrilled hole receptacles, for insertion and removal with no need for permanent fasteners, such as nails.

Plumb line vertical alignments of the vertical façade walls 2, 2*a*, 2*b* and 2*c* of the assembled housing shelter structure 1 are achieved with vertically installed T-shaped uprights without necessity of using levels.

As shown in FIGS. 14-17, the foam filled panels 30 forming the walls and the foam filled panels 40 forming the roof 3 of the assembled housing shelter structure 1 add to weight bearing strength both horizontally and vertically for the wall panels 30, roof panels 40, and floor panels 50. Panels 30, 40 and 50 are coated with a specialized polyurea coating, which is a very rugged coating that is completely waterproof, mold-proof, with no corrosion. It is noted that the same polyurea coating is used by the military for blast mitigation. Polyurea compounds are inert elastomeric substances created by combining an isocyanate compound with a synthetic resinous compound.

T-shaped uprights 12 and T-shaped roof rafters 20, 21, as well as wall panels 30, roof panels 40, and floor panels 50, structural rim frame joist/girders 6, floor beams 52 and other connecting components of the housing shelter structure 1 can be laid flat in a transportable storage pod 90 for transport on a truck bed.

The components stored in the transportable storage pod 90 also include the modular prefigured raised bathroom facilities 60 and modular kitchen facilities 70, as well as HVAC and electrical components.

Door 35 is preinstalled installed in the factory within wall panel 34, and windows 32*a*, 32*b* and safety egress window 32*c* are preinstalled in selected wall panels 32.

Figure 9A:
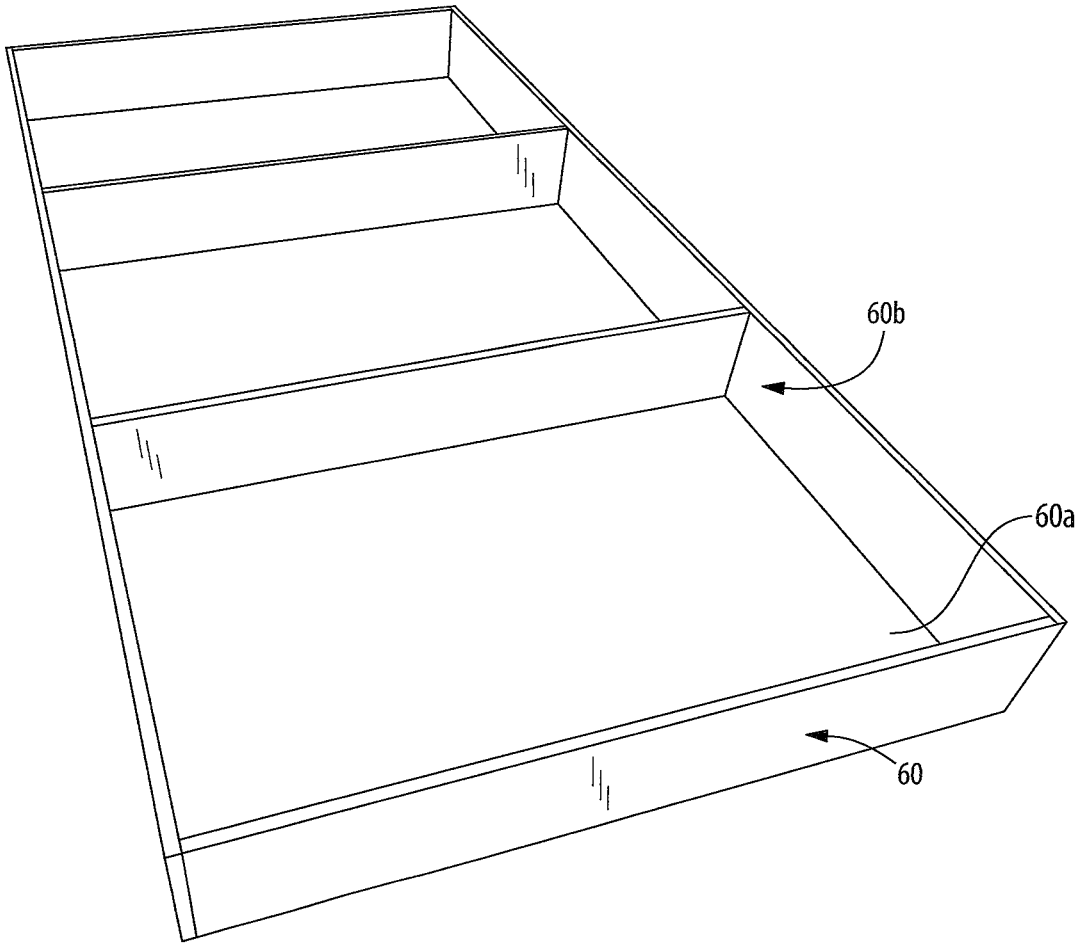
FIG. 9A is a perspective view of the raised frame for the bathroom module, showing the hollow space to accommodate plumbing and waste pipes therein.
Figure 9B:
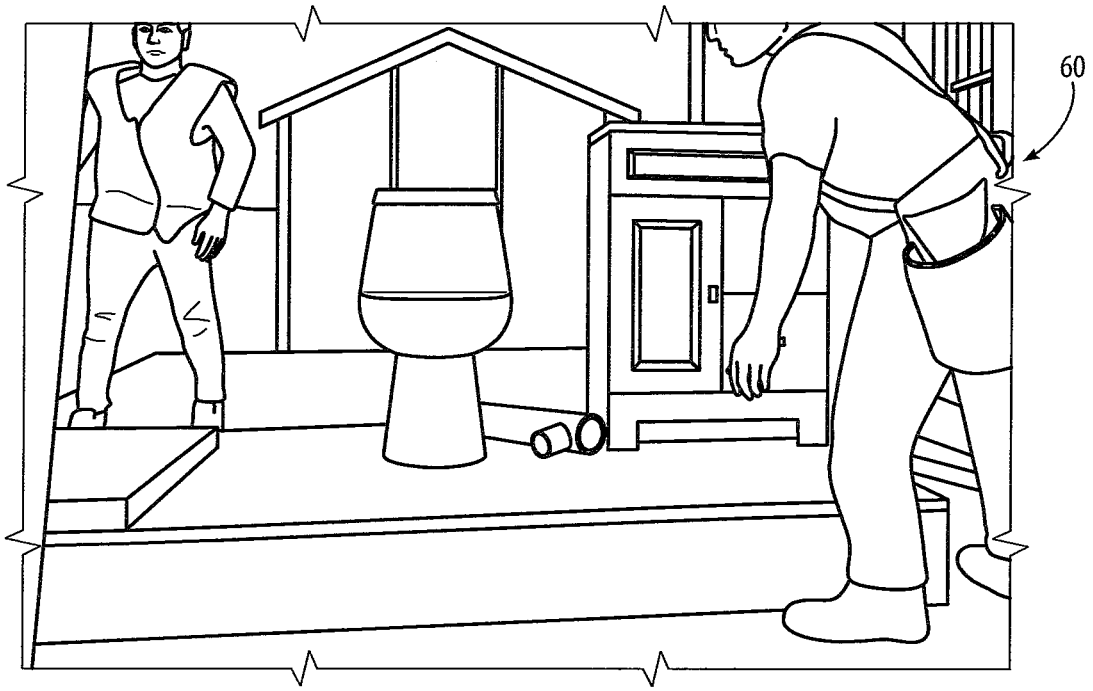
FIG. 9B is a front elevation view of a modular bathroom unit.
Figure 9C:
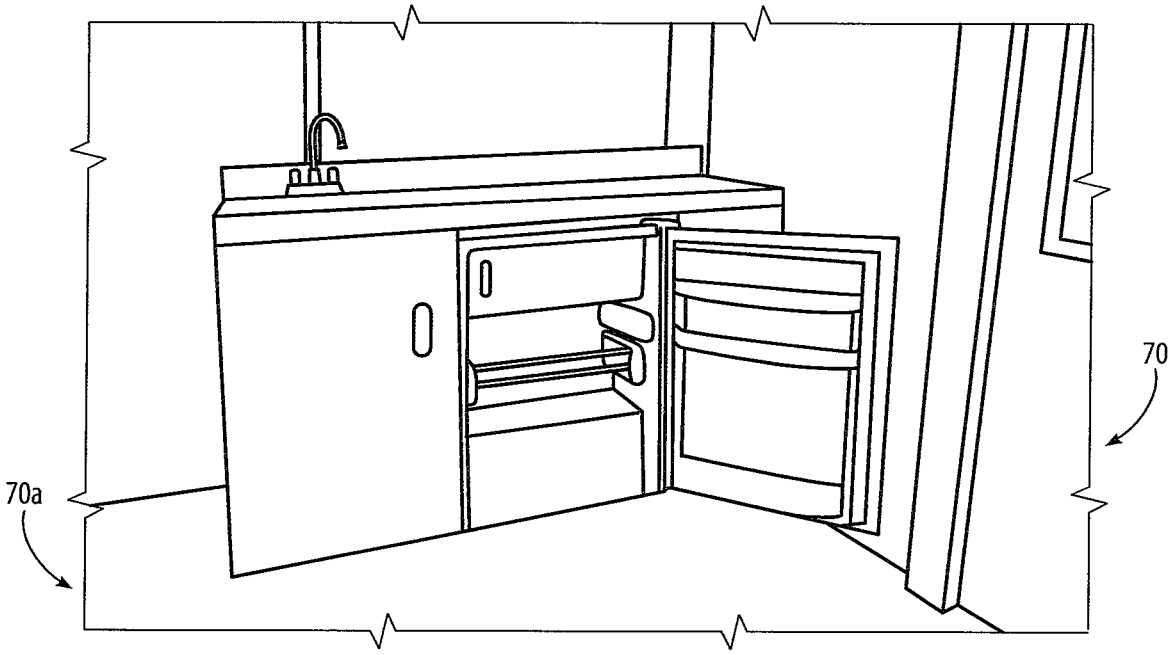
FIG. 9C is a front elevation view of a modular kitchen unit.

As shown in the plan view of FIG. 9, as well as in FIGS. 9A-9C, raised modular bathroom 60 has an elevated one step floor 60*a*, which is raised above hollow space 60*b* to accommodate plumbing pipes underneath. Bathroom components such as sink 60*c*, toilet 60*d* and shower/bath 60*e* are provided on the elevated platform floor 60*a*, to accommodate water and waste pipes in the hollow space 60*b* below the platform flooring 60*a*. These components are pre-installed and ready to be attached to water and waste hookups.

As also shown in FIGS. 9, 9A, 9B and 9C, the modular kitchen unit 70 backs up on the bathroom raised side wall 60*f* to accommodate using the bathroom plumbing and waste lines. The modular kitchen is a one-piece unit including floor 70*a*, joint 70*b* between the kitchen and bathroom raised wall 60*f* and includes kitchen sink 70*c*, kitchen stove 70*d* and kitchen refrigerator 70*e*.

Figure 29:
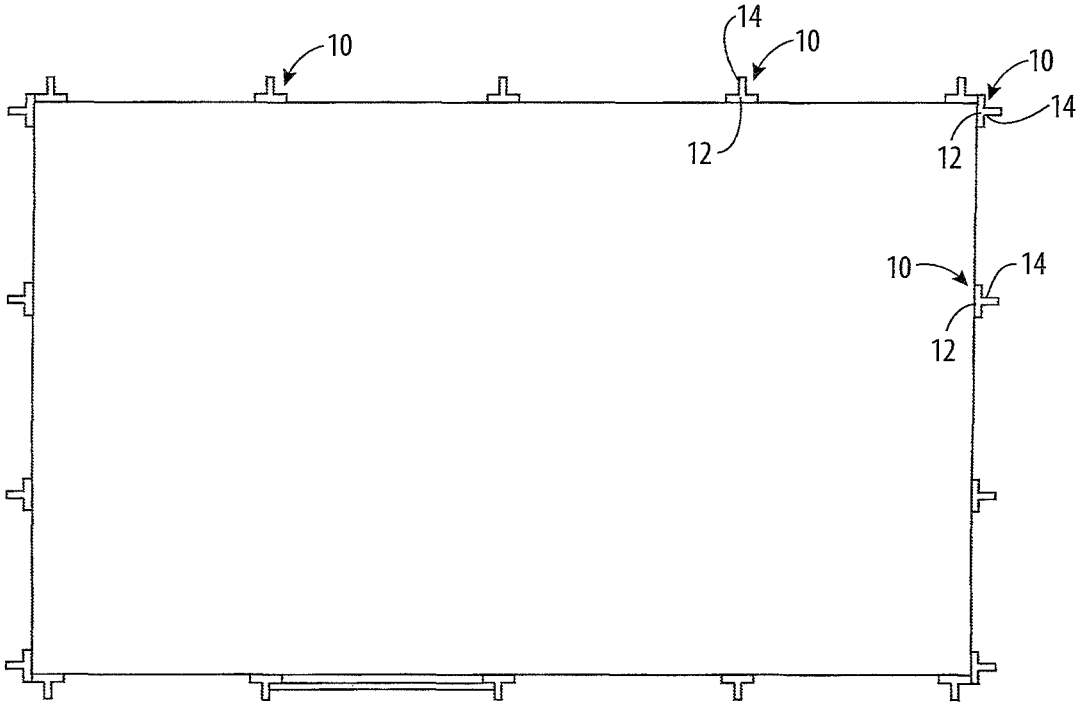
FIG. 29 is a top plan view of a platform of a rapidly deployable housing shelter, showing the positions of the T-shaped uprights secured thereto.

FIG. 29 is a top plan view of a platform of a rapidly deployable housing shelter 1, showing the positions of the T-shaped uprights.

FIG. 30 is a perspective view showing the platform and uprights of FIG. 29, and also includes a pair of rafters 20, 21 with each secured to an opposing pair of the T-shaped uprights 10, where the apex 42 of each of the two rafters 20, 21 are pivotally joined together by a piano hinge/hinge flap 44, which helps support the two rafters 20, 21 in a triangular shape for the roof 3 of the housing shelter unit 1. FIG. 30 also shows a preferred embodiment where the wall panel 30 can extend down to the ground level below the floor level and/or the concrete foundation 5 by lower portion 30*a*, as shown in FIG. 30. The wall panel 30 may extend a predetermined distance 30*a*, below the floor 50*a*, wherein the floor has parallel interior floor beams 52 supporting insulated floor panels 50, to form a complete floor 50*a*, (as shown in FIGS. 13 and 30). This lower predetermined portion 30*a* of wall panel 30 solves the problem of ground level seepage because the lower portion 30*a* of the wall panel 30 can extend outside the housing structure between the flanged T-shaped joists 10 and 12, which hold the wall panel 30 on the outside of the temporary housing structure. Therefore, the wall panels 30 between the joists 10 and 12 can extend down to the ground the distance of the lower portion 30*a* thereof. The floor 50*a* can therefore be elevated above the ground because a space can be provided below the floor 50*a*. Because the lower portion 30*a* of the wall panel 30 extends down below the floor 50*a*, there is no possibility of groundwater or rainwater seepage through the bottom of the extended wall panel portion 30*a* on the outside of the temporary housing structure.

The assembled housing shelter unit 1 can withstand a Category 1 Hurricane force winds, and potentially winds of higher categories depending on how the shelter is fastened to the ground.

The completed housing shelter unit 1 utilizes little energy from passive or active solar sources, for easy energy use off grid from public utility power.

The assembled housing shelter unit 1 leaves no footprint left after disassembly and removal from the site. Since the components are all interchangeable and modular, damaged parts can be easily replaced.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A method of assembling and disassembling a temporary housing shelter unit comprising the steps of:

preparing a foundation including a rectangular-shaped perimeter;

mounting, to side surfaces of the rectangular-shaped perimeter of said foundation, a base of each of a plurality of identical T-shaped uprights spaced equally apart along the rectangular shaped perimeter of the foundation, wherein each T-shaped upright further comprises an outstanding leg, said outstanding leg of each of the plurality of T-shaped uprights facing away from the foundation;

nesting prefabricated insulated wall panels between and against the outstanding leg of adjacent T-shaped uprights and releasably securing the prefabricated wall panels to one side of the base of each of the adjacent T-shaped uprights using removable fasteners extending into pre-drilled receptacle holes;

some of said wall panels containing a built-in doorway and windows;

installing prefabricated floor units including floor units with built-in kitchen and bathroom facilities including major appliances;

installing a plurality of pairs of T-shaped roof rafters, each pair formed into a triangular shape and spanning respective uprights at opposite sides of the foundation, portions of each roof rafter having notches engaging a top end of each respective upright, and facing the outstanding leg of each of the plurality of T-shaped roof rafters upwardly and away from the foundation;

sliding and nesting insulated roof panels into place between and against the outstanding leg of adjacent T-shaped sloped members of adjacent roof rafters to enclose a roof area of said housing shelter unit;

releasably securing said roof panels to said roof rafters using removable fasteners extending into pre-drilled receptacle holes;

disassembling said housing shelter unit by removing all of said removable fasteners and packaging said roof panels and wall panels, uprights and roof rafters;

whereby said housing shelter unit is constructed without use of nails or adhesives to facilitate both assembly and disassembly; and disassembling and packing the housing shelter unit in a pod thereby readying the housing shelter unit for field assembling of the temporary housing shelter unit at a next selected site.

2. The method of claim 1 in which said foundation comprises concrete pier footings.

3. The method of claim 1 in which said wall panels are constructed of a plastic foam.

4. The method of claim 3 in which said wall panels are provided with a polyurea coating making said wall panels waterproof, weatherproof, windproof, airtight and mold resistant without requiring separate roofing or siding.

5. The method of claim 1 in which all parts of said unit are prefabricated and flat-packed for shipping to a site for assembly.

6. The method of claim 1 comprising the step of mounting a ridge strap at an apex of each roof rafter.

7. The method of claim 1 in which a screw gun is employed to engage and disengage said fasteners.

8. The method of claim 1 in which said notches formed in each roof rafter are precisely angled to accommodate upper portions of said uprights to insure vertical plumb line of structural sides of said housing shelter unit.

9. The method of claim 1 in which said T-shaped uprights are vertical support posts which form nesting regions for wall, floor and roof framing panels.

10. The method of claim 1 in which said roofing panels are identical to said wall panels except for doors and windows in some wall panels.

11. The method of claim 1 further comprising: installing the kitchen floor unit and the bathroom floor unit on an elevated platform to accommodate water and waste pipes below which are pre-installed and ready to be attached to hookups.

12. The method of claim 11 further comprising: installing the kitchen floor unit adjacent to the bathroom floor unit to accommodate using common plumbing and waste lines.

13. A pod containing components of a housing shelter unit comprising:

a plurality of uprights, each of said uprights formed with a T-shaped cross-section having a base leg, and a centrally positioned outstanding leg protruding away from said base leg, and each said outstanding leg extending outwardly away from a foundation of said modular house shelter unit when said base of said T-shaped uprights are installed against a side surface of the foundation;

a plurality of wall panels each configured to nest between and against said outstanding leg of adjacent said uprights and be releasably secured to a corresponding said base leg during assembly to form vertical walls of the housing shelter unit;

prefabricated floor units including floor units with built-in kitchen and bathroom facilities;

a plurality of roof panels;

a plurality of pairs of roof supports with each pair formed into a triangular shape, each of said roof supports formed with a T-shaped cross-section having a base leg, and an outstanding leg protruding away from said base leg; wherein said outstanding leg is configured to protrude upwardly and away from of said T-shaped uprights when each said pair of said T-shaped roof supports are installed upon a corresponding pair of said uprights, and thereby support said roof panels of the housing shelter unit upon each said base leg and between adjacent said outstanding legs;

said components being constructed in a factory and ready for assembly on site; and said components configured to be flat stacked in said pod to be ready for being shipped to a housing site.

14. The pod of claim 13 said wall panels are constructed of a plastic foam.

15. The pod of claim 14 in which said wall panels are provided with a polyurea coating making said wall panels waterproof, weatherproof, windproof, airtight and mold resistant without requiring separate roofing or siding.

16. The pod of claim 15 in which said roofing panels are identical to said wall panels except for doors and windows in some wall panels.

17. The pod of claim 16 in which said kitchen facility and said bathroom facility are configured to be installed on one or more elevated platforms to accommodate water and waste pipes below which are pre-installed and ready to be attached to hookups.

18. A modular house shelter unit configured for assembly and disassembly using only screws and a screwdriver, said modular house shelter unit comprising:

a plurality of preformed concrete piers, each configured for a first portion to be received beneath a ground surface and for a second portion to protrude above the ground surface;

a plurality of circumferentially extending joists; said second portion of each of said plurality of preformed concrete piers configured to support a portion of said plurality of circumferentially extending joists;

a plurality of rows of floor beams configured to extend between portions of said plurality of circumferentially extending joists;

a plurality of floor panels removably fastened to said plurality of circumferentially extending joists and to said plurality of rows of floor beams;

a plurality of uprights, each of said plurality of uprights formed with a T-shaped cross-section having a base leg, and an outstanding leg protruding away from said base leg and extending outwardly from said modular house shelter unit;

wherein pairs of said plurality of uprights are removably secured to opposite sides of said plurality of circumferentially extending joists with said outstanding leg facing away from said foundation;

a plurality of wall panels;

wherein each of said plurality of wall panels in configured to nest between said outstanding leg of each adjacent pair of said uprights;

a plurality of pairs of roof rafters with each pair formed into a triangular shape; each said rafter formed with a T-shaped cross-section having a base leg and an outstanding leg configured to protrude away from said base leg of said rafter; and each said pair of roof rafters comprising:

a first rafter, a second rafter, and a connector, said connector configured join a first end of said first rafter to a first end of said second rafter to form a triangular shape;

wherein each said pair of roof rafters are positioned, in said triangular shape, to rest upon, and releasably secure to, an opposing pair of said plurality of uprights with said outstanding leg of each of said pairs of roof rafters facing upwardly and away from said foundation;

a plurality of roof panels; and wherein each of said plurality of roof panels is configured to nest between said outstanding leg of each adjacent pair of said roof rafters and be releasably secured to one side of said base of each of each adjacent pair of said roof rafters, to form a gable roof without a conventional ridge plank.

19. The modular house shelter unit according to claim 18, wherein said connector is a hinge, said hinge configured to pivotally couple said first end of said first rafter to said first end of said second rafter, being thereby configured to occupy a retracted position for transport, where said first and second rafters are positioned substantially parallel to each other, and an extended position, where said first end of said first rafter butts against said first end of said second rafter, and said first and second rafters form said triangular shape.

20. The modular house shelter unit according to claim 18, wherein said connector is a ridge strap.

21. The modular house shelter unit according to claim 18, further comprising:

a plurality of screws;

wherein one or more of said plurality of screws are configured to releasably secure a first side of each said wall panel to said base leg of a first one of said adjacent pair of said uprights; and one or more of said plurality of screws are configured to secure a second side of each said wall panel to said base leg of a second one of said adjacent pair of said uprights; and wherein one or more of said plurality of screws are configured to releasably secure a first side of each said roof panel to said base leg of a first one of said adjacent pair of said roof rafters;

and one or more of said plurality of screws are configured to secure a second side of each said roof panel to said base leg of a second one of said adjacent pair of said roof rafters.

22. The modular house shelter unit according to claim 18, wherein one of said plurality of wall panels comprises: a doorway; and wherein at least one of said plurality of wall panels comprises: a window.

* * * * *